US007354244B2

(12) United States Patent
Hasbargen et al.

(10) Patent No.: US 7,354,244 B2
(45) Date of Patent: Apr. 8, 2008

(54) BLOWER AND METHOD OF CONVEYING FLUIDS

(75) Inventors: Michael Robert Hasbargen, Troy, OH (US); John W. O'Neill, Tipp City, OH (US); Anthony Joseph Coloma, Troy, OH (US); Kevin Mark Field, Oconomowoc, WI (US); Darrell Wayne Schuh, Troy, OH (US); Dennis R. Hughes, Hartford, WI (US); Jason Robert Abele, Milwaukee, WI (US)

(73) Assignee: AOS Holding Company, Wilmington, DE (US)

( * ) Notice: Subject to any disclaimer, the term of this patent is extended or adjusted under 35 U.S.C. 154(b) by 332 days.

(21) Appl. No.: 11/216,781

(22) Filed: Aug. 31, 2005

(65) Prior Publication Data

US 2006/0065211 A1 Mar. 30, 2006

Related U.S. Application Data

(60) Provisional application No. 60/606,453, filed on Sep. 1, 2004.

(51) Int. Cl.
*F04D 29/44* (2006.01)

(52) U.S. Cl. ..... 415/212.1; 416/1

(58) Field of Classification Search ..... 415/206, 415/212.1; 417/423.14; 416/1
See application file for complete search history.

(56) References Cited

U.S. PATENT DOCUMENTS 45,026 A 11/1864 Cramer
87,625 A 3/1869 Bookwaller
263,839 A 9/1882 Barden
515,314 A 2/1894 Graham (Continued)

FOREIGN PATENT DOCUMENTS

BE 505227 8/1951

(Continued)

OTHER PUBLICATIONS

Magnetek Engineering drawings illustrating a blower, dated Jan. 16, 1968-Dec. 5, 1997.

(Continued)

*Primary Examiner*—Edward K. Look
*Assistant Examiner*—Devin Hanan
(74) *Attorney, Agent, or Firm*—Michael Best & Friedrich LLP

(57) ABSTRACT

A blower for a water heater having a flue defining a flue axis. The blower includes a housing at least partially defining a first chamber and a second chamber and having an inlet opening into the first chamber and an outlet communicating between the second chamber and atmosphere, the inlet being alignable with the flue, a ramp extending through the second chamber and having a surface, the surface being oriented at an acute angle with respect to the flue axis, and an impeller positioned in the second chamber and being operable to draw exhaust from the flue into the first chamber through the inlet and being operable to direct the exhaust through the second chamber and across the surface of the ramp, the surface of the ramp directing the exhaust through the outlet in a direction substantially parallel to the flue axis.

22 Claims, 21 Drawing Sheets

U.S. PATENT DOCUMENTS

| | | | |
|---|---|---|---|
| 921,624 | A | 5/1909 | Parnall |
| 1,421,865 | A | 7/1922 | Veeder |
| 1,602,009 | A | 10/1926 | Germeyer |
| 1,649,161 | A | 11/1927 | Foster |
| 1,650,873 | A | 11/1927 | Kay |
| 1,707,719 | A | 4/1929 | Goldthwaite |
| 1,740,710 | A | 12/1929 | Parker et al. |
| 1,802,642 | A | 4/1931 | Fernstrum |
| 1,803,421 | A | 5/1931 | Benson et al. |
| 1,860,068 | A | 5/1932 | Bassler |
| 1,965,171 | A | 7/1934 | Boyer |
| 2,121,754 | A | 6/1938 | Cornell, Jr. |
| 2,188,741 | A | 1/1940 | Roberts |
| 2,770,009 | A | 11/1956 | Rogal et al. |
| 2,890,660 | A | 6/1959 | Umbricht |
| 2,898,030 | A | 8/1959 | Hull |
| 2,916,997 | A | 12/1959 | Terrie |
| 2,987,983 | A | 6/1961 | Solzman |
| 3,251,540 | A | 5/1966 | Kinsworthy |
| 3,305,164 | A | 2/1967 | Laing |
| 3,365,118 | A | 1/1968 | Winfield, Jr. |
| 3,375,983 | A | 4/1968 | Von Eiff et al. |
| 3,542,496 | A | 11/1970 | Bergeson et al. |
| 3,743,439 | A | 7/1973 | Cann |
| 3,777,975 | A | 12/1973 | Kofink |
| 3,867,064 | A | 2/1975 | Sorensen et al. |
| 3,901,212 | A | 8/1975 | Stites |
| 3,970,411 | A | 7/1976 | Wallman |
| 3,977,062 | A | 8/1976 | Wallman |
| 4,041,593 | A | 8/1977 | Wallman |
| 4,091,794 | A | 5/1978 | Stites |
| 4,120,084 | A | 10/1978 | Wallman |
| 4,171,089 | A | 10/1979 | Schossow |
| 4,247,250 | A | 1/1981 | Lipe et al. |
| 4,255,292 | A | 3/1981 | Giersch et al. |
| 4,289,730 | A | 9/1981 | Tomlinson |
| 4,422,288 | A | 12/1983 | Steber |
| 4,424,792 | A | 1/1984 | Shimek et al. |
| 4,425,058 | A | 1/1984 | Sorensen et al. |
| 4,475,868 | A | 10/1984 | Renger |
| 4,481,935 | A | 11/1984 | Bawel |
| 4,494,598 | A | 1/1985 | DeHaan et al. |
| 4,515,527 | A | 5/1985 | Baker |
| 4,537,178 | A | 8/1985 | Hwang et al. |
| 4,543,892 | A | 10/1985 | Tomlinson et al. |
| 4,549,848 | A | 10/1985 | Wallman |
| 4,583,494 | A | 4/1986 | Gordon, Jr. |
| 4,603,680 | A | 8/1986 | Dempsey et al. |
| 4,611,622 | A | 9/1986 | Ahn |
| 4,653,466 | A | 3/1987 | DeHaan et al. |
| D289,680 | S | 5/1987 | Heob |
| 4,672,819 | A | 6/1987 | Mino et al. |
| 4,681,024 | A | 7/1987 | Ivey |
| 4,681,085 | A | 7/1987 | Clawson |
| 4,718,401 | A | 1/1988 | DeLancey |
| 4,726,353 | A | 2/1988 | Clawson |
| 4,729,328 | A | 3/1988 | Shellenberger |
| 4,750,433 | A | 6/1988 | Guzorek |
| 4,757,802 | A | 7/1988 | Guzorek |
| 4,768,444 | A | 9/1988 | DeWerth et al. |
| 4,771,708 | A | 9/1988 | Douglass, Jr. |
| 4,799,287 | A | 1/1989 | Belanger et al. |
| 4,799,855 | A | 1/1989 | Milocco et al. |
| 4,834,285 | A | 5/1989 | Besik |
| 4,836,753 | A | 6/1989 | Berfield et al. |
| 4,856,550 | A | 8/1989 | Smelcer |
| 4,856,982 | A | 8/1989 | Olson |
| 4,860,725 | A | 8/1989 | Tallman et al. |
| 4,880,364 | A | 11/1989 | Berfield et al. |
| 4,884,946 | A | 12/1989 | Belanger et al. |
| 4,892,045 | A | 1/1990 | Schumacher |
| 4,899,726 | A | 2/1990 | Waterman |
| 4,901,376 | A | 2/1990 | Ivey |
| 4,917,572 | A | 4/1990 | Van Houten |
| 4,924,848 | A | 5/1990 | Vaughn |
| 4,930,981 | A | 6/1990 | Walker |
| 4,995,375 | A | 2/1991 | Jackson |
| 5,022,811 | A | 6/1991 | Wallman |
| 5,040,943 | A | 8/1991 | Dwyer et al. |
| 5,046,922 | A | 9/1991 | Nakamura et al. |
| 5,070,772 | A | 12/1991 | Guzorek |
| 5,094,224 | A | 3/1992 | Diesch |
| 5,112,190 | A | 5/1992 | Kajiwara et al. |
| 5,115,798 | A | 5/1992 | Moore, Jr. et al. |
| 5,122,352 | A | 6/1992 | Johnson |
| 5,133,642 | A | 7/1992 | Kajiwara |
| 5,158,446 | A | 10/1992 | Hall |
| 5,205,725 | A | 4/1993 | Pattison |
| 5,221,183 | A | 6/1993 | Hoeffken |
| 5,239,917 | A | 8/1993 | Lutkie et al. |
| 5,255,665 | A | 10/1993 | Windon |
| 5,261,389 | A | 11/1993 | Trieb |
| 5,277,232 | A | 1/1994 | Borsheim |
| D346,020 | S | 4/1994 | Kellogg et al. |
| 5,309,890 | A | 5/1994 | Rieke et al. |
| 5,310,310 | A | 5/1994 | Nakatsukasa et al. |
| 5,314,300 | A | 5/1994 | Gatley, Jr. et al. |
| 5,316,439 | A | 5/1994 | Gatley, Jr. et al. |
| 5,341,795 | A | 8/1994 | Chou et al. |
| 5,352,099 | A | 10/1994 | Anstine et al. |
| 5,358,380 | A | 10/1994 | Arakawa |
| 5,368,010 | A | 11/1994 | Weber, III et al. |
| 5,375,586 | A | 12/1994 | Schumacher et al. |
| 5,375,651 | A | 12/1994 | Colwell |
| 5,379,749 | A | 1/1995 | Rieke et al. |
| 5,379,751 | A | 1/1995 | Larsen et al. |
| 5,385,444 | A | 1/1995 | Kobayashi et al. |
| 5,398,976 | A | 3/1995 | Webb |
| 5,414,999 | A | 5/1995 | Barnes |
| 5,437,263 | A | 8/1995 | Ellingham et al. |
| 5,448,986 | A | 9/1995 | Christopher et al. |
| 5,469,879 | A | 11/1995 | Rasmussen |
| 5,484,259 | A | 1/1996 | Ahmed et al. |
| 5,508,680 | A | 4/1996 | Larsen et al. |
| 5,536,140 | A | 7/1996 | Wagner et al. |
| 5,547,232 | A | 8/1996 | Waterman |
| 5,551,836 | A | 9/1996 | Roth et al. |
| 5,570,996 | A | 11/1996 | Smiley, III |
| 5,572,399 | A | 11/1996 | Shirato et al. |
| 5,620,302 | A | 4/1997 | Garrison et al. |
| 5,623,918 | A | 4/1997 | Swilik, Jr. et al. |
| 5,630,368 | A | 5/1997 | Wagoner et al. |
| 5,669,541 | A | 9/1997 | Ronconi |
| 5,671,880 | A | 9/1997 | Ronconi |
| 5,704,343 | A | 1/1998 | Ahn et al. |
| 5,735,018 | A | 4/1998 | Gallagher et al. |
| 5,749,355 | A | 5/1998 | Roan et al. |
| 5,775,318 | A | 7/1998 | Haydock et al. |
| 5,834,869 | A | 11/1998 | Morgan et al. |
| 5,864,190 | A | 1/1999 | Bacchiocchi |
| 5,899,662 | A | 5/1999 | Hojyo et al. |
| 5,903,072 | A | 5/1999 | Phillips |
| 5,911,155 | A | 6/1999 | Webb |
| 5,934,876 | A | 8/1999 | Nagy |
| 5,951,245 | A | 9/1999 | Sullivan |
| 5,954,476 | A | 9/1999 | Stewart et al. |
| 5,971,292 | A | 10/1999 | Roy et al. |
| 5,997,246 | A | 12/1999 | Humbad |
| 6,021,775 | A | 2/2000 | Dempsey et al. |
| 6,029,505 | A | 2/2000 | Webb |
| 6,036,167 | A | 3/2000 | Wade |
| 6,048,024 | A | 4/2000 | Wallman |
| 6,053,130 | A | 4/2000 | Shellenberger |
| 6,069,422 | A | 5/2000 | Garrison et al. |

| | | | | |
|---|---|---|---|---|
| 6,069,428 | A | 5/2000 | Nelson | |
| 6,096,372 | A | 8/2000 | Nomura et al. | |
| 6,109,254 | A | 8/2000 | Reinke et al. | |
| 6,116,269 | A | 9/2000 | Maxson | |
| 6,155,233 | A | 12/2000 | Wade et al. | |
| 6,155,781 | A | 12/2000 | Tsai | |
| 6,179,566 | B1 | 1/2001 | Andulics et al. | |
| 6,203,278 | B1 | 3/2001 | Mumpower | |
| 6,206,640 | B1 | 3/2001 | Andulics et al. | |
| 6,220,818 | B1 | 4/2001 | Andulics et al. | |
| 6,231,311 | B1 | 5/2001 | Gatley et al. | |
| 6,253,416 | B1 | 7/2001 | Lauer et al. | |
| 6,283,726 | B1 | 9/2001 | Fackelmann et al. | |
| 6,287,154 | B1 | 9/2001 | Palmer et al. | |
| 6,296,478 | B1 | 10/2001 | Gatley, Jr. | |
| 6,298,731 | B1 | 10/2001 | Wade et al. | |
| 6,307,337 | B1 | 10/2001 | Nelson | |
| 6,307,344 | B1 | 10/2001 | Pajak et al. | |
| 6,314,894 | B1 | 11/2001 | Gatley, Jr. | |
| 6,318,358 | B1 | 11/2001 | Gatley, Jr. | |
| 6,328,095 | B1 | 12/2001 | Felber et al. | |
| 6,332,755 | B1 | 12/2001 | Fujinaka et al. | |
| 6,332,759 | B1 | 12/2001 | Guillemin et al. | |
| 6,352,431 | B1 | 3/2002 | Gatley, Jr. | |
| 6,386,123 | B1 | 5/2002 | Gatley, Jr. | |
| 6,398,512 | B2 | 6/2002 | Stewart | |
| 6,406,275 | B1 | 6/2002 | Hoehn | |
| 6,428,288 | B1 * | 8/2002 | King | 417/366 |
| 6,435,818 | B1 | 8/2002 | Gatley, Jr. | |
| 6,468,034 | B1 | 10/2002 | Garrison et al. | |
| 6,494,152 | B2 | 12/2002 | Gatley, Jr. | |
| 6,508,627 | B2 | 1/2003 | Gerken et al. | |
| 6,511,288 | B1 | 1/2003 | Gatley, Jr. | |
| 6,511,290 | B1 | 1/2003 | Gatley, Jr. | |
| 6,530,346 | B1 | 3/2003 | Coones et al. | |
| 6,536,378 | B2 | 3/2003 | Lyons | |
| 6,537,030 | B1 | 3/2003 | Garrison | |
| 6,553,923 | B2 | 4/2003 | Gatley, Jr. | |
| 6,575,696 | B1 | 6/2003 | Lyons et al. | |
| 6,595,146 | B2 | 7/2003 | Gatley, Jr. | |
| 6,602,058 | B1 | 8/2003 | Stewart | |
| 6,609,893 | B2 | 8/2003 | Dobrzeniecki | |
| 6,622,660 | B1 | 9/2003 | Bajic et al. | |
| 6,666,660 | B2 | 12/2003 | Kegg et al. | |
| D491,259 | S | 6/2004 | Garrison et al. | |
| 6,745,724 | B2 | 6/2004 | Hughes et al. | |
| 6,821,088 | B2 | 11/2004 | Sakai et al. | |
| 6,827,560 | B2 * | 12/2004 | Gatley et al. | 417/423.14 |
| 6,892,844 | B2 * | 5/2005 | Atsuumi | 180/190 |
| 6,895,874 | B2 | 5/2005 | Gatley, Jr. | |
| 2001/0011853 | A1 | 8/2001 | Gatley et al. | |
| 2001/0038794 | A1 | 11/2001 | Stewart | |
| 2002/0014233 | A1 | 2/2002 | Gatley, Jr. et al. | |
| 2002/0023575 | A1 | 2/2002 | Gatley, Jr. | |
| 2002/0025252 | A1 | 2/2002 | Gatley, Jr. | |
| 2002/0098084 | A1 | 7/2002 | Gatley, Jr. | |
| 2002/0115036 | A1 | 8/2002 | Lyons | |
| 2002/0178980 | A1 | 12/2002 | Gatley, Jr. | |
| 2003/0123985 | A1 | 7/2003 | Dobrzeniecki | |
| 2003/0196610 | A1 | 10/2003 | Hughes et al. | |
| 2003/0198564 | A1 | 10/2003 | Gatley, Jr. et al. | |
| 2004/0258546 | A1 | 12/2004 | Gatley, Jr. | |
| 2005/0058560 | A1 | 3/2005 | Gatley, Jr. et al. | |

FOREIGN PATENT DOCUMENTS

| | | |
|---|---|---|
| DE | 34 46 435 | 7/1986 |
| DE | 92 05 295.9 | 6/1992 |
| DE | 43 12 094 | 10/1993 |
| DE | 93 14 195.5 | 11/1993 |
| DE | 195 17 398 | 11/1995 |
| DE | 296 08 984 | 8/1996 |
| DE | 297 05 212 | 7/1997 |
| DE | 297 10 273 | 9/1997 |
| DE | 94 20 718.6 | 2/1998 |
| DE | 298 07 361 | 11/1998 |
| DE | 200 06 951 | 8/2000 |
| DE | 200 12 030 | 2/2001 |
| EP | 0 310 188 | 4/1989 |
| EP | 0 396 294 | 11/1990 |
| EP | 0 470 053 | 2/1992 |
| EP | 0 679 841 | 11/1995 |
| EP | 0 801 266 | 10/1997 |
| FR | 72.39623 | 2/1974 |
| GB | 2 187 829 | 9/1987 |
| GB | 2 189 311 | 10/1987 |
| GB | 2 220 469 | 1/1990 |
| GB | 2 289 424 | 11/1995 |
| GB | 2 290 371 | 12/1995 |
| GB | 2 354 313 | 3/2001 |
| JP | 60194425 | 10/1985 |
| JP | 2001207207 | 7/2001 |
| JP | 2003056496 | 2/2003 |
| WO | WO 93/14320 | 7/1993 |

OTHER PUBLICATIONS

Engineering drawings illustrating a Fasco "Condensation Collector", date stamped Sep. 10, 2002.
Magnetek Replacement Motor Manual 496.
Article entitled "Fasco Fans and Blowers", Catalog No. 92-B-1, Fasco Motor Group, St. Louis, Missouri, USA.
Article entitled "McMillian Shaded Pole Motors".
Article entitled "Fasco high-efficiency condensing furnace blowers".
Article entitled "Dayton Shaded Pole and P.S.C. Blowers", Blower Installation and Maintenance Information.
Advertisement for Fasco "New Swirlwind High-Performance Blowers".
Article entitled "A Venting Process" from May 1995 issue of *Appliance*.
Magnetek Engineering drawings illustrating a blower, dated Jan. 16, 1968-Dec. 5, 1997.
Engineering drawings illustrating a Fasco "Condensation Collector", date stamped Sep. 10, 2002.
Magnetek Replacement Motor Manual 496. Date Apr. 1996.
Article entitled "Dayton Shaded Pole and P.S.C. Blowers", Blower Installation and Maintenance Information. Date- 1996.
Advertisement for Fasco "New Swirlwind High-Performance Blowers". Date 1985.
Article entitled "A Venting Process" from May 1995 issue of *Appliance*.

* cited by examiner

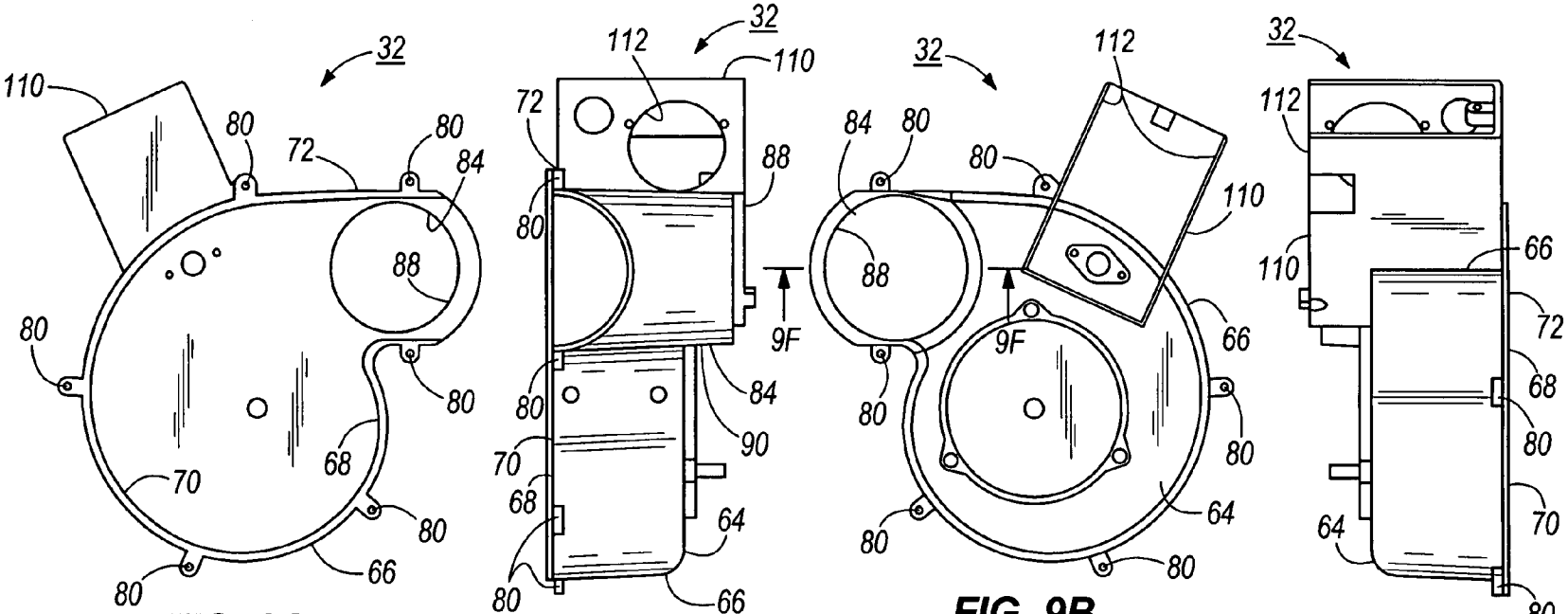
FIG. 9A
FIG. 9B
FIG. 9C
FIG. 9E
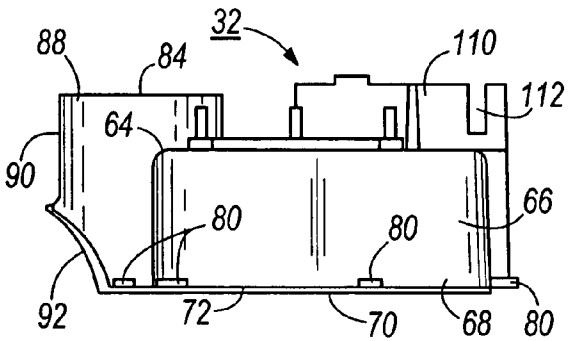
FIG. 9D
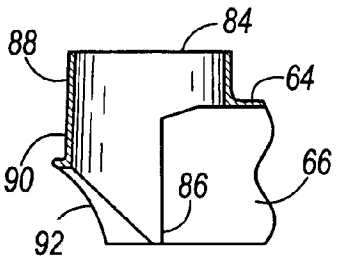
FIG. 9F

BLOWER AND METHOD OF CONVEYING FLUIDS

RELATED APPLICATIONS

The present application claims the benefit of prior-filed, co-pending provisional patent application Ser. No. 60/606,453, filed Sep. 1, 2004.

FIELD OF THE INVENTION

The present invention relates to blowers and, more particularly, to a blower for a water heater.

SUMMARY

Conventional water heaters generally include a tank for containing water, a combustion chamber positioned below the tank for heating the water in the tank and a flue extending through the tank to direct products of combustion from the combustion chamber toward the atmosphere. Conventional water heaters can also include a blower for directing the products of combustion from the flue through a venting system toward the atmosphere.

In some constructions and in some aspects, the water heater generally includes a tank, a flue extending through the tank and defining an axis and a blower positioned above the tank and having an exhaust opening generally aligned with the flue along the axis.

In some constructions and in some aspects, the water heater generally includes a tank, a flue extending through the tank and defining an axis and a blower positioned above the tank and including a first housing and a second housing, the first housing being positioned between the second housing and the tank for receiving products of combustion from the flue. The first housing can include a wall at least partially defining an interior space and a dilution air inlet extending radially outwardly from the wall and communicating between the interior space and atmosphere. Atmospheric air can be mixed with the products of combustion in the interior space of the first housing before the products of combustion move into the second housing.

In some constructions and in some aspects, the water heater generally includes a tank, a flue extending through the tank and defining an axis and a blower positioned above the tank and including a housing having an inlet generally aligned with the flue along the axis and having an exhaust duct generally aligned with the inlet along the axis. A fan can be supported in the housing to draw products of combustion axially through the inlet and can expel the products of combustion radially outwardly toward the exhaust duct. The exhaust duct can include an angled wall, which directs the products of combustion axially through the duct.

Also, in some constructions and in some aspects, the system generally includes a water heater, a blower connected to the water heater and having an exhaust duct, a venting system communicating with atmosphere and a coupling positioned between the exhaust duct and the venting system and having a drain to prevent condensate from entering the blower.

In addition, in some aspects and in some constructions, the invention provides a blower for a water heater having a flue defining a flue axis. The blower includes a housing at least partially defining a first chamber and a second chamber and having an inlet opening into the first chamber and an outlet communicating between the second chamber and atmosphere, the inlet being alignable with the flue, a ramp extending through the second chamber and having a surface, the surface being oriented at an acute angle with respect to the flue axis, and an impeller positioned in the second chamber and being operable to draw exhaust from the flue into the first chamber through the inlet and being operable to direct the exhaust through the second chamber and across the surface of the ramp, the surface of the ramp directing the exhaust through the outlet in a direction substantially parallel to the flue axis.

Further, in some aspects and in some constructions, the invention provides a blower for a water heater having a flue defining a flue axis. The blower includes a housing at least partially defining a first chamber and a second chamber and having a first inlet opening into the first chamber, a second inlet opening into the first chamber for receiving ambient air, and an outlet communicating between the second chamber and atmosphere, the first inlet being alignable with the flue, an impeller positioned in the second chamber, the impeller being operable to draw exhaust from the flue into the first chamber through the first inlet and being operable to draw the exhaust into the second chamber before directing the exhaust through the outlet, and a ramp extending through the first chamber adjacent to the second inlet for directing ambient air from the second inlet toward the first inlet.

Also, in some aspects and in some constructions, the invention provides a blower for a water heater having a flue defining a flue axis. The blower includes a housing at least partially defining a first chamber and a second chamber and having an inlet opening into the first chamber and an outlet communicating between the second chamber and atmosphere, the inlet being alignable with the flue, a ramp extending through the second chamber and having a first surface oriented at an acute angle with respect to the flue axis, and a second surface opposite the first ram surface and oriented at an obtuse angle with respect to the axis, and an impeller positioned in the second chamber and being operable to draw exhaust from the flue into the first chamber through the inlet and being operable to direct the exhaust through the second chamber and through the outlet.

Further, in some aspects and in some constructions, the invention provides a method of operating a blower for a water heater, the water heater including a flue defining a flue axis, the blower including a housing at least partially defining a first chamber and a second chamber and having an inlet opening into the first chamber and an outlet communicating between the second chamber and atmosphere, and an impeller positioned in the second chamber. The method includes the acts of moving the impeller with respect to the housing to draw exhaust from the flue through the inlet into the first chamber and from the first chamber into the second chamber, and directing the exhaust through the outlet along a path substantially coaxial with the flue axis.

Independent features and independent advantages of the present invention will become apparent to those skilled in the art upon review of the following detailed description and drawings.

BRIEF DESCRIPTION OF THE DRAWINGS

FIG. 9A is a bottom view of an upper housing of the blower shown in FIG. 1.

FIG. 9B is a top view of the upper housing shown in FIG. 9A.

FIG. 9C is a front view of the upper housing shown in FIG. 9A.

FIG. 9D is a side view of the upper housing shown in FIG. 9A.

FIG. 9E is a rear view of the upper housing shown in FIG. 9A.

FIG. 9F is a sectional view of a portion of the upper housing taken along line F-F' of FIG. 9B.

Figure 1:
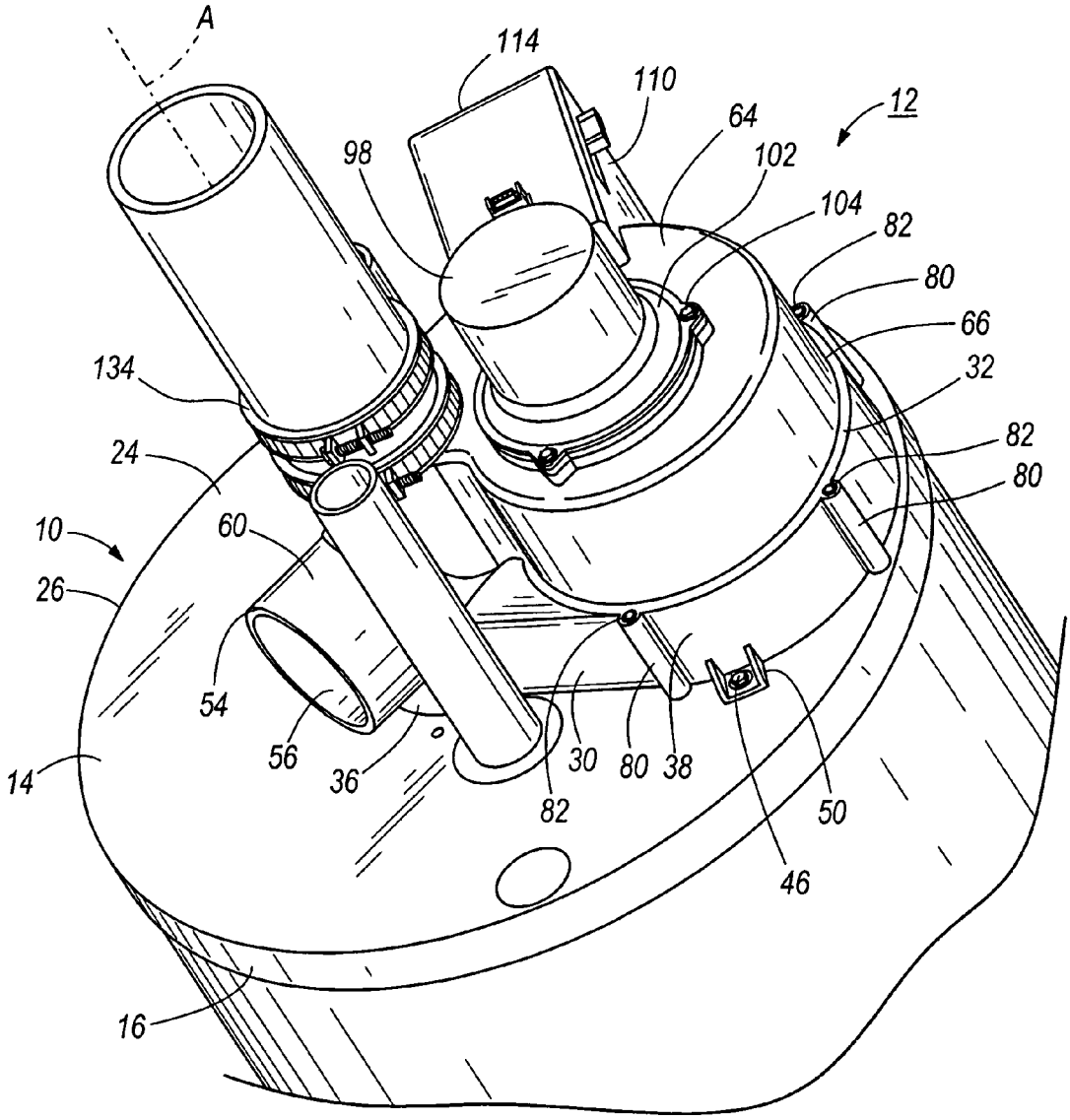
FIG. 1 is a top perspective view of a water heater including a blower and a coupling embodying the invention.
Figure 2:
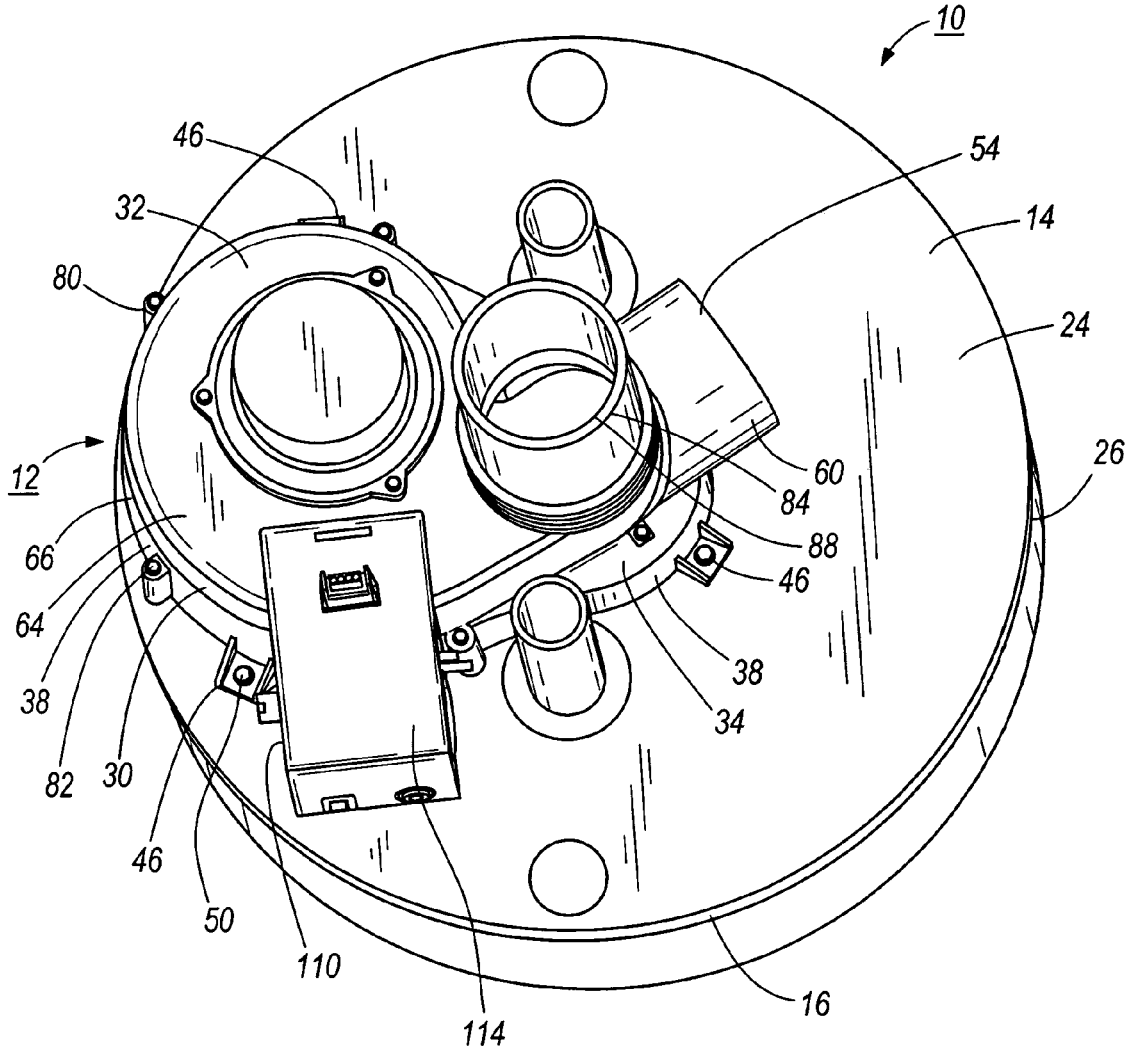
FIG. 2 is a top view of the water heater shown in FIG. 1.
Figure 3:
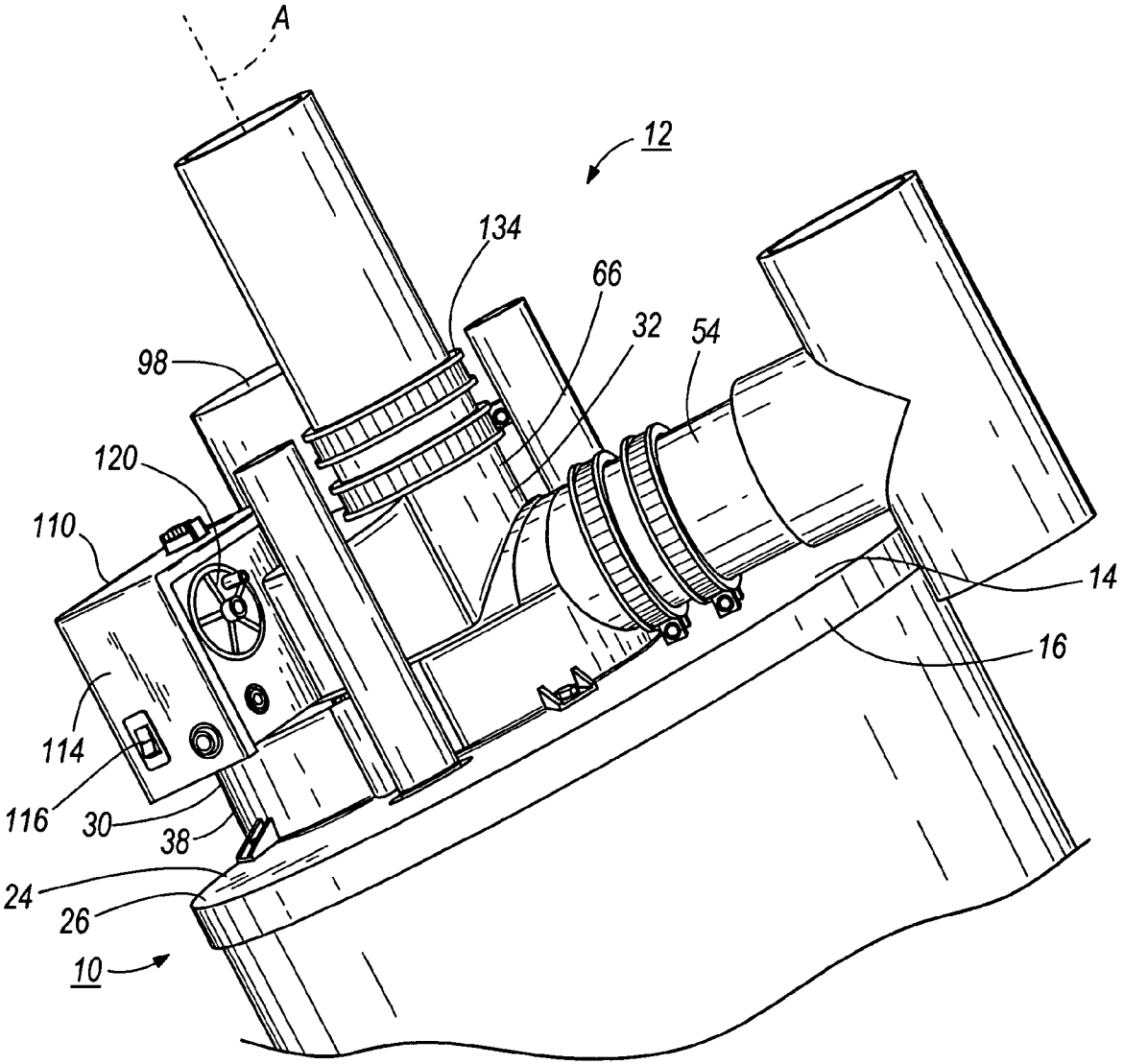
FIG. 3 is a perspective view of a first side of the water heater shown in FIG. 1.
Figure 4:
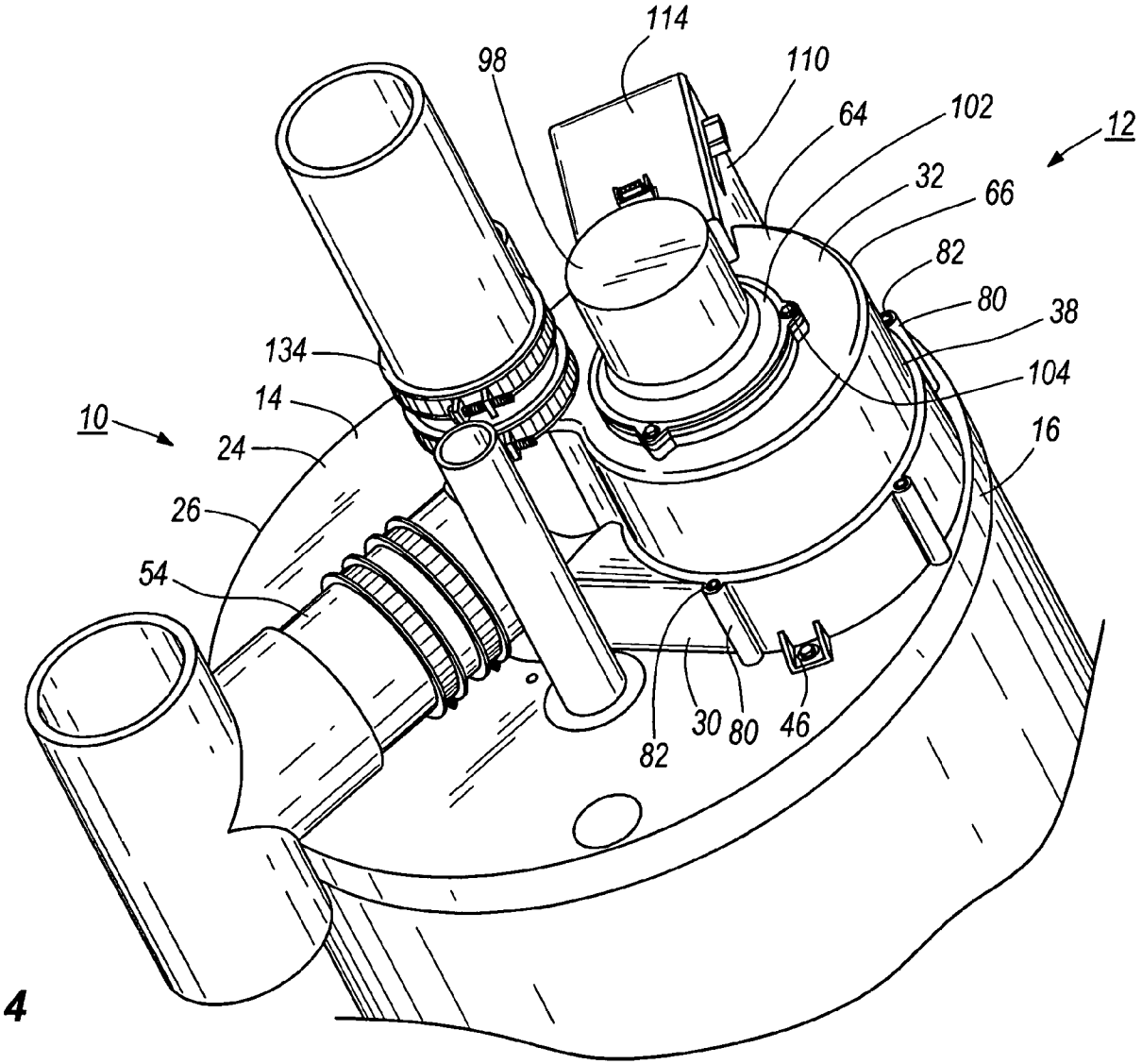
FIG. 4 is a perspective view of a second side the water heater shown in FIG. 1.
Figure 6:
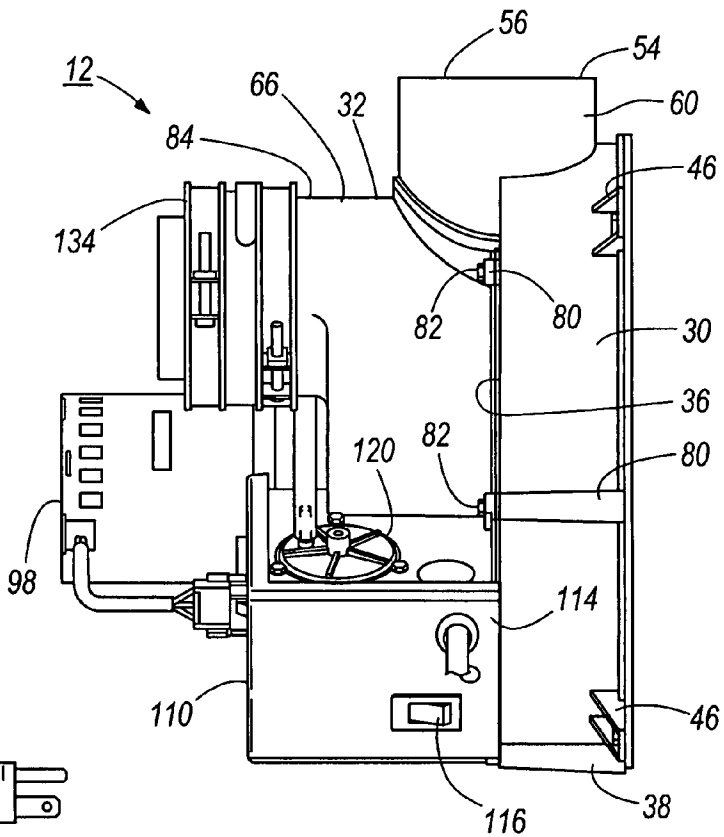
FIG. 6 is a side view of the blower shown in FIG. 1.
Figure 5:
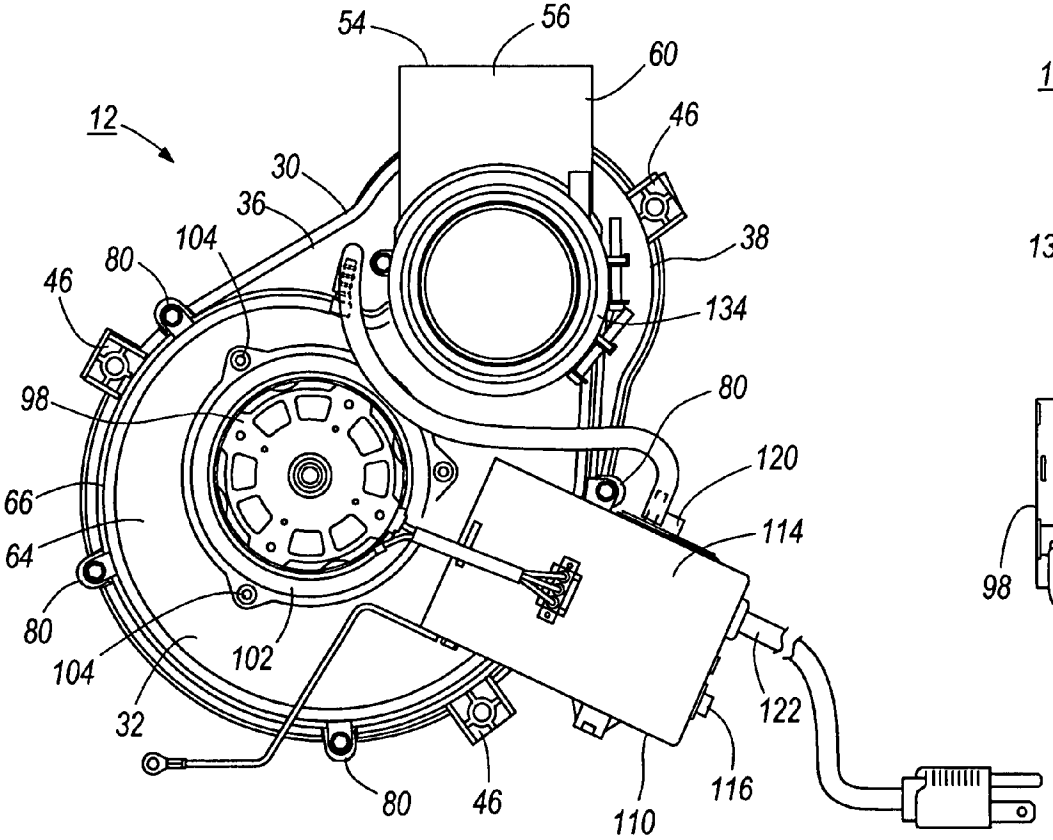
FIG. 5 is a top view of the blower shown in FIG. 1.

Before at least one embodiment of the invention is explained in detail, it is to be understood that the invention is not limited in its application to the details of construction and the arrangements of components set forth in the following description or illustrated in the drawings. The invention is capable of other embodiments and of being practiced or of being carried out in various ways.

Also, it is to be understood that the phraseology and terminology used herein with reference to element orientation (such as, for example, terms like "front", "back", "up", "down", "top", "bottom", "vertical", "horizontal", "upstream", "downstream", etc.) are only used to simplify description of the present invention, and do not alone indicate or imply that the element referred to must have a particular orientation. In addition, terms such as "first" and "second" are used herein for purposes of description and are not intended to indicate or imply relative importance or significance.

DETAILED DESCRIPTION

A water heater 10 and a blower 12 embodying independent aspects of the invention are illustrated in FIGS. 1-4. The water heater 10 can be located in a building or structure, such as, for example, a home, office or other commercial building to heat water in a conventional manner for use in or around the structure.

As shown in FIGS. 1-4, the water heater 10 includes a tank 14 for containing water to be heated, an outer jacket or housing 16 surrounding the tank 14 and a flue 18 extending substantially vertically through the tank 14. In the illustrated construction of FIG. 3 and in some aspects, the flue 18 is substantially centrally located within the tank 14 and defines a central axis A extending through the tank 14 in a generally vertical direction.

Although not shown, the water heater 10 can also include a combustion chamber located below the tank 14 and a burner extending through at least a portion of the combustion chamber. Fuel can be supplied to the burner through a fuel line and a gas valve. When the burner is activated, a pilot burner ignites fuel flowing out of the burner. During operation, the burner burns fuel and air drawn into the combustion chamber. This combustion generates products of combustion, such as, for example, exhaust and water vapor, which rise through the flue 18 and heat the water in the tank 14 by conduction through the flue walls.

The blower 12 is supported on an upper wall 24 of the tank 14. In the illustrated construction of FIGS. 1-4 and in some aspects, the blower 12 or a substantial portion of the blower 12 is supported in a central location on the upper wall 24 of the tank 14 so that the entire blower 12 or at least a substantial portion of the blower 12 is located within an outer perimeter 26 of the tank 14. In this manner, no portion of the blower 12 or only a small portion of the blower 12 overhangs the outer perimeter 26 of the tank 14. In these constructions and in these aspects, the tank 14 and the blower 12 can be located in relatively small spaces, such as, for example, basements, utility closets, etc. Moreover, because no portion of the blower 12 or only a relatively small portion of the blower 12 overhangs the outer perimeter 26 of the tank 14, the tank 14 and/or the blower 12 can be more easily installed in place of existing water heaters and/or blowers without requiring substantial modification of the existing venting systems. This relatively compact arrangement of the blower 12 and the tank 14 also simplifies packaging and shipment of the blower 12 and the tank 14.

In the illustrated construction and in some aspects, the blower 12 includes a first or lower housing 30 and a second or upper housing 32 or housing portions. In other constructions and in other aspects, the blower 12 can include one, three or more housings. In some constructions and in some aspects, the first and second housings 30, 32 are formed from corrosion resistant materials such as polymers and plastics. In other aspects and in other constructions, other materials including ferrous metals, aluminum, ceramics and/or composite materials can also or alternatively be used.

As explained in greater detail below, the first housing 30 is located adjacent to the upper wall 24 of the tank 14 and can be exposed to relatively high-temperature products of combustion (e.g., having a temperature of between about 400° F. and about 500° F.). As also explained below, in some constructions and in some aspects, the second housing 32 can also be exposed to relatively high-temperature products of combustion (e.g., having a temperature of between about 150° F. and about 200° F.). Accordingly, in some constructions and in some aspects, one or both of the first and second housings 30, 32 can be formed of a relatively high-temperature-resistant plastic. In other constructions and in other aspects, the first housing 30 can be formed of a relatively high-temperature-resistant material and the second housing 32 can be formed of a relatively lower-temperature-resistant material.

As shown in FIGS. 1-8D, the first housing 30 includes an upper wall 36 and a sidewall 38 extending downwardly from the upper wall 36. Together, the upper wall 36 and the sidewall 38 at least partially define an interior space 40. In the illustrated construction and in some aspects, the first housing 30 also includes an open bottom 42 defined by the sidewall 38. In other constructions and in other aspects (not shown), the first housing 30 can include a bottom wall having an opening communicating with the interior space 40.

In the illustrated construction of FIGS. 1-4 and in some aspects, the first housing 30 is supported on the upper wall 24 of the tank 14 so that the open bottom 42 of the first housing 30 is generally aligned with the flue 18 along the central axis A, allowing products of combustion to travel from the combustion chamber, through the flue 18 and into the interior space 40.

Figure 7:
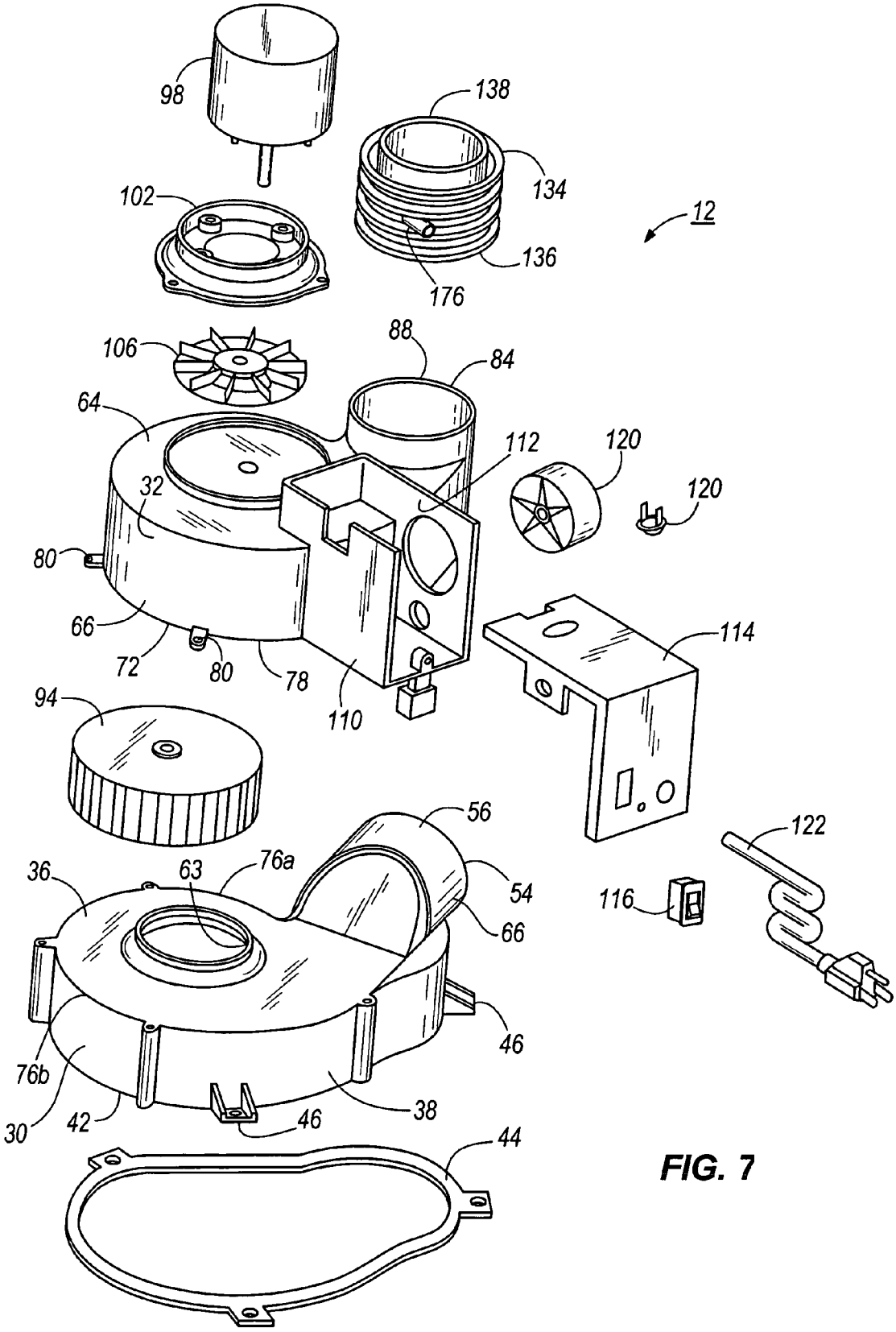
FIG. 7 is an exploded perspective view of the blower shown in FIG. 1.

As shown in FIG. 7, in some aspects and in some constructions, a gasket 44 is positioned between the upper wall 24 of the tank 14 and the sidewall 38 of the first housing 30, forming a seal between the upper wall 24 of the tank 14 and the first housing 30 and preventing products of combustion from escaping to the atmosphere between the blower 12 and the tank 14.

Flanges 46 extend radially outwardly from the sidewall 38 and support fasteners 50, which secure the first housing 30 to the upper wall 24 of the tank 14. Any conventional fastener can be employed to secure the first housing 30 to the tank 14 as just described, such as, for example, screws, nails, rivets, pins, posts, clips, clamps, inter-engaging elements and combinations of such fasteners.

The first housing 30 can also include a dilution air inlet 54. In the illustrated construction of FIGS. 1-8D and in some aspects, the dilution air inlet 54 extends radially outwardly from the sidewall 38 and communicates between the atmosphere and the interior space 40 of the first housing 30. As shown in FIGS. 8A-8D, the dilution air inlet 54 can include an inlet opening 56 communicating with the atmosphere, an outlet opening 58 communicating with the interior space 40 and a wall 60 extending between the inlet and outlet openings 56, 58. In the illustrated construction and in some aspects, at least a portion of the wall 60 slopes upwardly and outwardly from the upper wall 36 toward the inlet opening 56, forming a ramp 61 for directing ambient air downwardly toward the open bottom 42 of the first housing 30 and toward the flue 18.

In the illustrated construction of FIGS. 8A-8D, the ramp 61 includes a first ramp surface 61*a*, which is oriented at an obtuse angle $\alpha$ with respect to the central axis A. In this manner and as explained in greater detail below, ambient atmospheric air can be drawn into the first housing 30 through the dilution air inlet 54, directed downwardly along the first ramp surface 61*a* into the flue 18 and mixed with the products of combustion to cool the products of combustion before the mixture of ambient air and products of combustion exit the first housing 30 through an outlet 63 defined in the upper wall 36 of the first housing 30.

The dilution air inlet 54 can also include a grate or screen 62 (shown in FIG. 8C) to prevent or minimize access to the interior space 40 of the first housing 30. In some aspects and in some constructions, the screen 62 is integrally formed with the dilution air inlet 54 and the lower housing 30. In other constructions and in other aspects, the screen 62 may be removeably connected to the housings 30, 32.

In the illustrated construction of FIGS. 1-8A and in some aspects, the dilution air inlet 54 is open to the structure surrounding the water heater 10 to draw atmospheric air from the structure into the interior space 40. In other constructions and in other aspects (not shown), the dilution air inlet 54 can be in fluid communication with a venting system to draw atmospheric air from a remote location, such as, for example, from outside the structure.

As shown in FIGS. 1-7 and 9A-9F, the second housing 32 is supported on the upper wall 36 of the first housing 30. The second housing 32 includes an upper wall 64 and a sidewall 66 extending downwardly from the upper wall 64. Together, the upper wall 64 and the sidewall 66 of the second housing 32 and the upper wall 36 of the first housing 30 at least partially define an interior space 68. In the illustrated construction and in some aspects, the second housing 32 also includes an open bottom 70 defined by the sidewall 66. In these constructions and in these aspects, the open bottom 70 is aligned with the outlet 63 in the upper wall 36 of the first housing 30 to receive products of combustion from the first housing 30. In other constructions and in other aspects (not shown), the second housing 32 can include a bottom wall having an opening communicating with the interior space 68.

A rib 72 extends downwardly from the sidewall 66 of the second housing 32 and is engageable in a channel 74 formed between ribs 76*a*, 76*b*, which extend upwardly from the upper wall 36 of the first housing 30, to form a seal between the first and second housings 30, 32. In other constructions and in other aspects, the first housing 30 can include an upwardly extending rib, which is engageable in a channel formed between downwardly extending ribs of the second housing 32, to form a seal between the first and second housings 30, 32. In the illustrated construction of FIG. 7 and in some aspects, the blower 12 also includes a gasket 78, such as, for example, an elastic rope sealant gasket, which can be secured between the sidewall 66 of the second housing 32 and the upper wall 36 of the first housing 32 to provide a seal between the first and second housings 30, 32.

In the illustrated construction of FIGS. 1-7 and 9A-9E, flanges 80 extend radially outwardly from the sidewall 66 and support fasteners 82, which secure the second housing 32 to the upper wall 36 of the first housing 30. Any conventional fastener can be employed to secure the second housing 32 to the first housing 30 as just described, such as, for example, screws, nails, rivets, pins, posts, clips, clamps, inter-engaging elements and combinations of such fasteners.

Figure 8A:
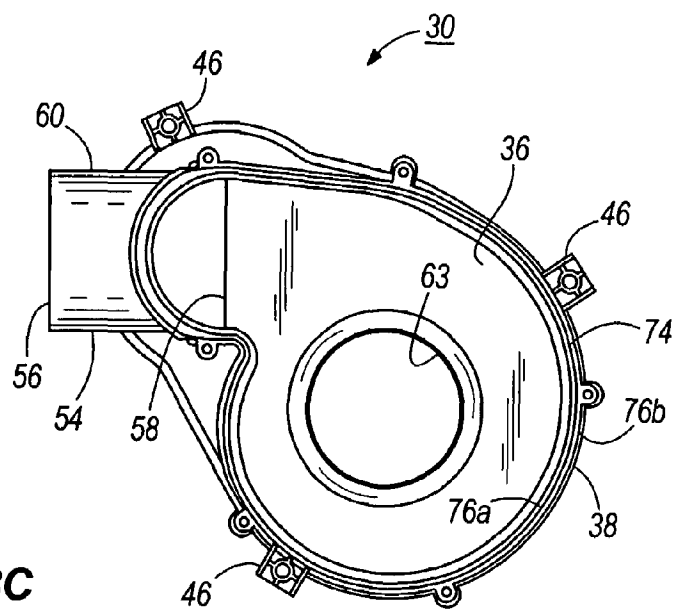
FIG. 8A is a top view of a lower housing of the blower shown in FIG. 1.
Figure 8C:
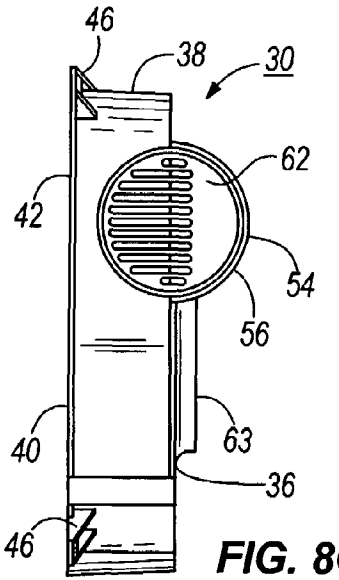
FIG. 8C is a front view of the lower housing shown in FIG. 8A.
Figure 8B:
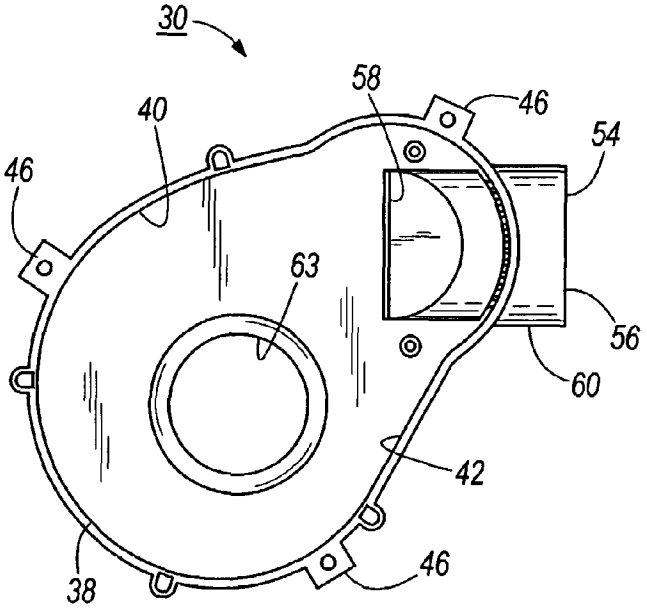
FIG. 8B is a bottom view of the lower housing shown in FIG. 8A.
Figure 8D:
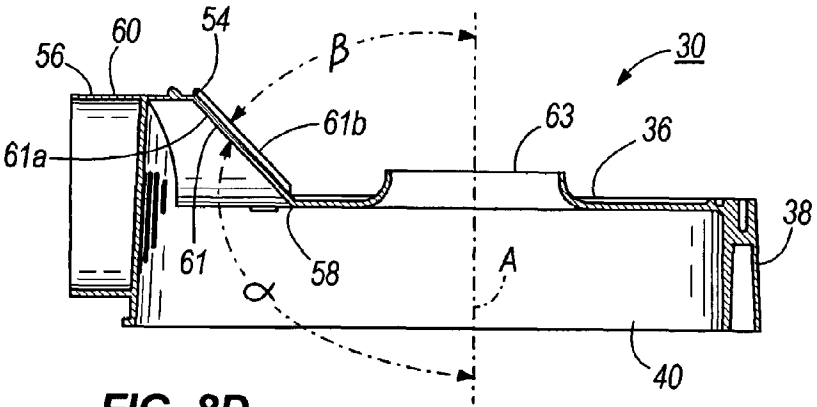
FIG. 8D is a side view of the lower housing shown in FIG. 8A.
Figure 10A:
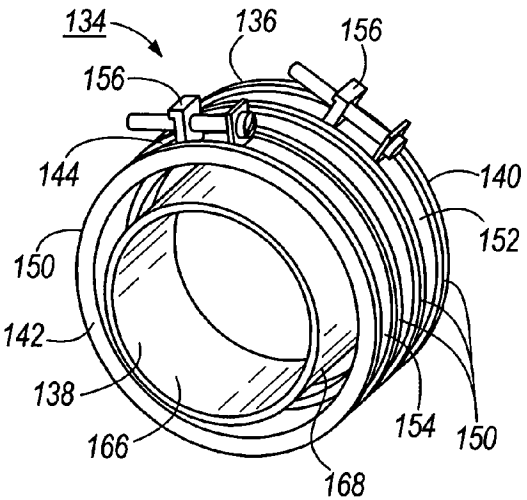
FIG. 10A is a rear perspective view of the coupling shown in FIG. 1.
Figure 10D:
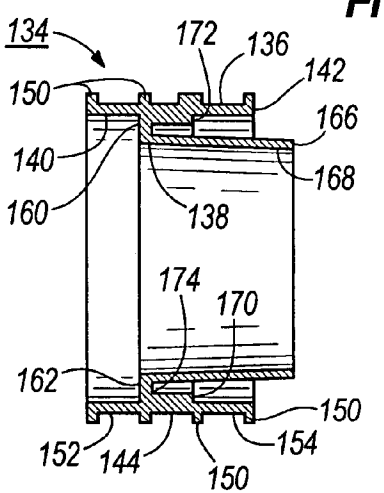
FIG. 10D is a cross-sectional view of the coupling taken along line D-D' of FIG. 10B.
Figure 10E:
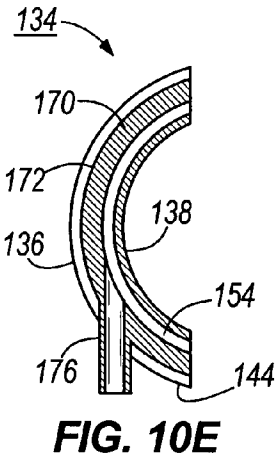
FIG. 10E is an enlarged cross-sectional view of a portion of the coupling taken along line E-E' of FIG. 10C.
Figure 10B:
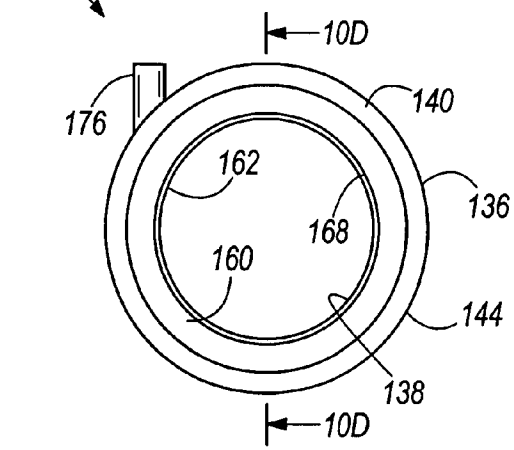
FIG. 10B is a front view of the coupling shown in FIG. 10A.
Figure 10C:
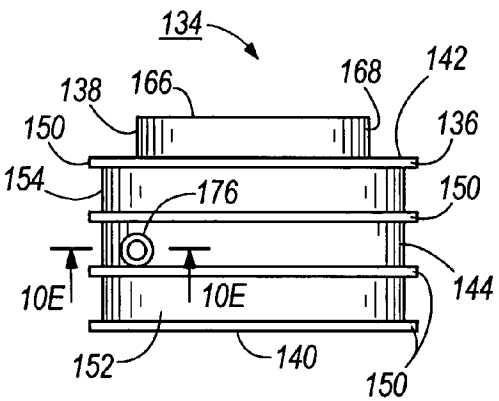
FIG. 10C is a side view of the coupling shown in FIG. 10A.

As shown in FIGS. 2, 6, 7 and 9A-9E, the second housing 32 also includes an exhaust duct 84 having an inlet opening 86 extending radially through the sidewall 66 and a generally vertically oriented outlet 88 extending upwardly and outwardly from the second housing 32 in a direction generally parallel to the central axis A. The exhaust duct 84 also includes an annular wall 90 extending between the inlet 86 and the outlet 88. In some aspects and in some constructions, at least a portion of the annular wall 90 is sloped to direct air, which enters the inlet 86 in a generally horizontal direction, upwardly and outwardly through the outlet 88 in a generally vertical direction. In the illustrated construction of FIGS. 9D and 9F and in some aspects, at least a portion of the annular wall 90 is formed with an opening 92. In these constructions and in these aspects, the sloped wall 60 of the dilution air inlet 54 forms a second ramp surface 61 for directing air, which enters the inlet 86 of the exhaust duct 84 in a generally horizontal direction, upwardly and outwardly through the outlet 88 in a generally vertical direction. As shown in FIG. 8D, the second ramp surface 61*b* can be oriented at an acute angle β with respect to the central axis A. In this manner, the sloped surface of the annular wall 90 or the ramp surface 61*b* of the wall 60 provide a gradual transition for the products of combustion, preventing or reducing the formation of turbulence and maintaining relatively laminar flow through the exhaust duct 84. As shown in FIG. 8D, the first and second ramp surfaces 61*a*, 61*b* are formed on opposite sides of the ramp 61.

As shown in FIG. 7, the second housing 32 can also support a fan wheel 94 having a plurality of individual vanes that create a centrifungal flow of air when the fan wheel 94 rotates. The fan wheel 94 is mounted to a driving motor 98 which is operable to rotate the fan wheel 94 to create a flow of air out of the outlet opening 88 and through the exhaust venting.

The motor 98 is supported above the second housing 32 on a motor mounting bracket 102, which is secured to the upper wall 64 of the second housing 32 with fasteners 104. In the illustrated construction of FIG. 7 and in some aspects, a motor fan 106 is supported between the motor mounting bracket 102 and the upper wall 64 of the second housing 32 and is operable to draw air axially through the motor 98 to cool the motor 98 during motor operation.

In some constructions and in some aspects, the blower 12 also includes an electrical component housing 110. In the illustrated construction of FIGS. 1-7 and 9A-9D and in some aspects, the electrical component housing 110 is secured to the second housing 32 and defines an interior space 112. A two-sided cover 114 can be secured to the housing 110 to substantially enclose the interior space 112. In some constructions and in some aspects, the housing 110 supports a controller (not shown), a power switch 116, an electrical circuit (not shown) and a number of sensors 120, such as, for example, a thermal overlimit switch, a thermostat, etc.

The electrical circuit is connectable to a power source, which supplies power to the controller 114 and the motor 98. The power source may include an AC power source, such as line power (through a power cord 122 (see FIGS. 5 and 7)), or a DC power source, such as a battery.

In operation, fuel is burned in the combustion chamber, generating products of combustion that rise through the flue 18 and heat the water in the tank 14 by conduction through the flue walls. From the flue 18, the products of combustion enter the blower 12 through the open bottom 42 of the first housing 30. The products of combustion enter the interior space 40 of the first housing 30 at an elevated temperature (e.g., between about 400° F. and about 500° F.). Rotation of the fan wheel 94 draws atmospheric air through the dilution air inlet 54 and along the first ramp surface 61*a*, which directs the atmospheric air downwardly toward the open bottom 42 of the first housing 30 and into the flue 18, wherein the dilution air is mixed with the products of combustion to cool the products of combustion (e.g., to a temperature of between about 150° F. and about 200° F.).

Continued rotation of the fan wheel 94 draws the combined products of combustion/dilution air mixture (the "mixture") axially through the outlet 63 in the upper wall 36 of the first housing 30 and the open bottom 70 of the second housing 32 and into the interior space 68 of the second housing 32. Rotation of the fan 94 also generates a centrifugal flow, forcing the mixture radially outwardly through the inlet opening 86 of the exhaust duct 84. Once in the exhaust duct 86, the sloped annular wail 90 or, alternatively, the second ramp surface 61*b* redirects the generally horizontal flow of mixture upwardly along a generally vertical flow path and into a venting system. The mixture then travels through the venting system and is vented to the atmosphere.

In the illustrated construction of FIGS. 1-7 and 10A-10E and in some aspects, the water heater 10 also includes a coupling 134 connected between the outlet 88 of the exhaust duct 84 and the venting system. In other constructions and in other aspects, the coupling 134 can be located between two sections of the venting system. As shown in FIGS. 1-7 and 10A-10E, the coupling 134 can include first and second substantially concentric tubes 136, 138 having any cross-sectional shape desired, such as, for example, a round shape, a rectangular, triangular, or other polygonal shape, an irregular shape, etc. By way of example only, the first and second tubes 136, 138 of the illustrated construction are generally elongated and have a generally circular cross-sectional shape.

In some constructions and in some aspects, the first and second tubes 136, 138 are formed from corrosion resistant materials such as polymers and plastics. In other aspects and in other constructions, other materials including ferrous metals, aluminum, ceramics and/or composite materials can also or alternatively be used. In the illustrated construction and in some aspects, portions of the coupling 134, including the first and second tubes 136, 138, are formed from a rubber/plastic compound, which is relatively resistant to corrosion and is relatively resilient to reduce the transmission of vibrations and noise from the blower 12 through the venting system.

In the illustrated construction of FIGS. 10A-10E and in some aspects, the first and second tubes 136, 138 are integrally formed to provide additional strength, to reduce manufacturing costs and/or to prevent leakage between the first and second tubes 136, 138. In other constructions and in other aspects, the first and second tubes 136, 138 can be separately formed and can be secured together with fasteners such as, for example, screws, nails, rivets, pins, posts, clips, clamps, inter-engaging elements and combinations of such fasteners.

The first tube 136 includes an upstream end 140, a downstream end 142 and a outer wall 144 extending between the upstream and downstream ends 140, 142. In the illustrated construction of FIGS. 1-7 and 10A-10E and in some aspects, the upstream end 140 is frictionally engageable with the outlet 88 of the exhaust duct 84 and the downstream end 142 is frictionally engageable with the venting system. In other constructions and in other aspects, the upstream end 140 can be secured to the venting system and the downstream end 142 can be secured to the exhaust duct 84 or, alternatively, the coupling 134 can be located along the venting system with the upstream and downstream ends 140, 142 secured to respective first and second sections of the venting system.

In the illustrated construction of FIGS. 1-7 and 10A-10E and in some aspects, the outer wall 144 includes a number of radially extending ribs 150, which define channels 152, 154 adjacent to respective upstream and downstream ends 140, 142. Clamps 156 are engageable in the channels 152, 154 to secure the coupling 134 to the exhaust duct 84 and the venting system or, alternatively, to secure the coupling 134 between two or more sections of the venting system. In other constructions and in other aspects, other conventional fasteners, such as, for example, screws, nails, rivets, pins, posts, clips, inter-engaging elements and combinations of such fasteners can be used.

A lip 160 extends radially inwardly from the interior of the first tube 136 and is secured to an upstream end 162 of the second tube 138. The lip 160 can also provide a stop for engagement with the exhaust duct 84 or a portion of the venting system to limit movement between the coupling 134 and the exhaust duct 84 or the venting system.

The second tube 138 includes a downstream end 166 and a wall 168 extending between the upstream and downstream ends 162, 166. In the illustrated construction and in some aspects, the second tube 138 has a generally frusto-conical shape and is tapered along its length between the upstream and downstream ends 162, 166.

A rib 170 extends radially inwardly from the wall 144 of the first tube 136 and provides a stop 172 for engagement with the exhaust duct 84 or, alternatively, for engagement with a portion of the venting system. Together, the rib 170, a downstream side of the lip 160 and an exterior side of the wall 168 define a channel 174.

In the illustrated construction of FIGS. 10A-10E and in some aspects, the coupling 134 also includes a drain 176 extending radially outwardly through the wall 144 of the first tube 136 and communicating between the channel 174 and the atmosphere.

In operation, as heated air travels through the venting system, the air cools, and condensate may form. Condensate formed along the walls of the venting system drains downwardly toward the blower 12 and enters the coupling 134. This condensate is collected in the channel 174 and is directed through the channel 174 toward the drain 176. In the illustrated construction and in some aspects, condensate exits the drain 176 and is allowed to flow onto the floor or into a collection bucket arranged below the drain 176. In other constructions and in other aspects, the drain 176 can be provided with a hose to direct the condensate to a floor drain or another desired collection point. To improve flow to the drain 176, the coupling 136 can be pivoted relative to the venting system and/or the exhaust duct 84 so that the drain 176 opens toward the floor.

Figure 11:
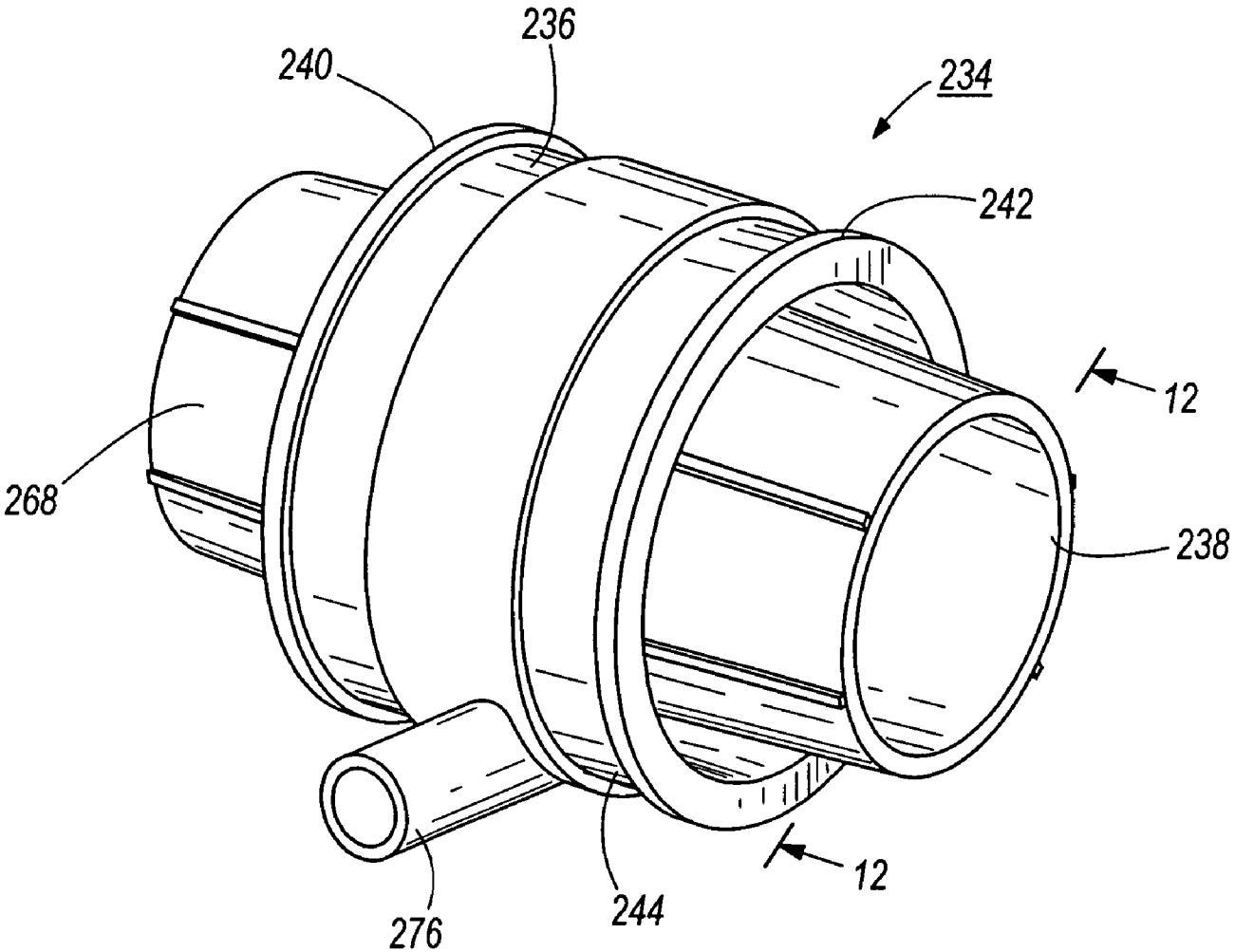
FIG. 11 is a perspective view of an alternate construction of a coupling.
Figure 12:
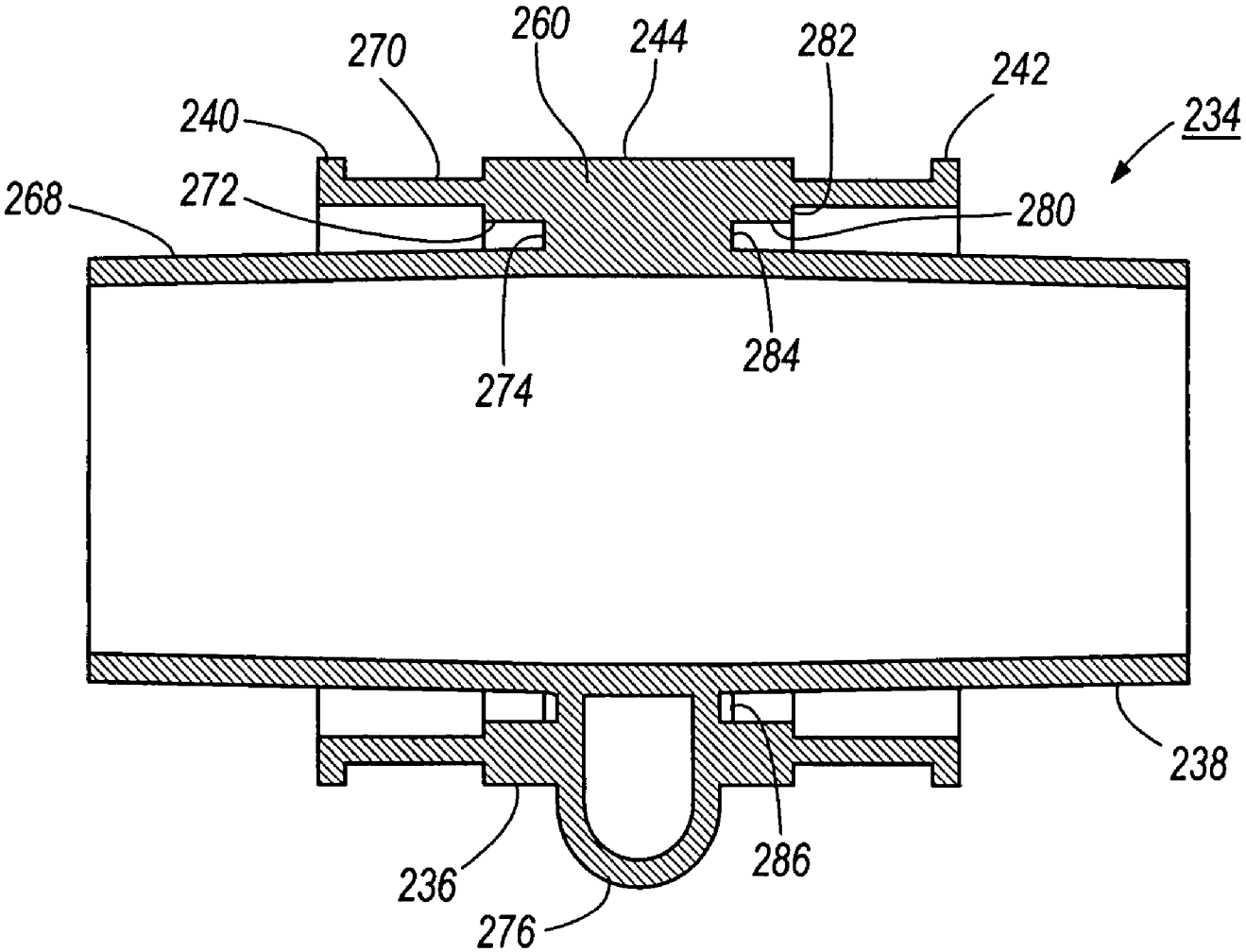
FIG. 12 is a sectional view taken along line 12-12' of FIG. 11.

Another construction of the coupling is illustrated in FIGS. 11 and 12. The coupling (indicated generally at 234) employs much of the same structure and has many of the same operational features as the coupling 134 described above and illustrated in FIGS. 1-7 and 10A-10E. Accordingly, the following description of the coupling 234 focuses primarily upon those elements and features of the coupling 234 that are different from the constructions described above. Reference should be made to the above description for additional information regarding the elements, operation and possible alternatives to the elements and operation of the coupling 234 not discussed below. Elements and features of the coupling 234 corresponding to the earlier-described coupling 134 are designated hereinafter in the 200 series of reference numbers.

In some constructions and in some aspects, the second tube 238 extends outwardly from both the upstream and downstream ends 240, 242 of the first tube 236. In these constructions and in these aspects, the coupling 234 can be coupled to the venting system and the exhaust duct 84 of the blower assembly 12 or, alternatively, the coupling 234 can be positioned along the venting system between two sections of the venting system. In addition, the coupling 234 can be oriented with the upstream end 240 facing toward the blower assembly 12 or, alternatively, with the upstream end 240 facing toward a portion of the venting system that opens to the atmosphere.

In the illustrated construction of FIGS. 11-12 and in some aspects, a first rib 270 extends radially inwardly from the wall 244 of the first tube 236 and provides a first stop 272 for engagement with the exhaust duct 84 or, alternatively, for engagement with a portion of the venting system. In these constructions and in these aspects, a second rib 280 extends radially inwardly from the wall 244 of the first tube 236 and provides a second stop 282 for engagement with a portion of the venting system or, alternatively, for engagement with the exhaust duct 84. The first rib 270, a downstream side of the lip 260 and an exterior side of the wall 268 define a first channel 274 and the second rib 280, an upstream side of the lip 260 and an exterior side of the wall 268 define a second channel 284.

In the illustrated construction of FIGS. 11-12 and in some aspects, the coupling 234 also includes a drain 276 extending radially outwardly through the wall 244 of the first tube 236 and communicating between the channel 274 and the atmosphere. In some constructions and in some aspects, the lip 260 includes a bore 286, which communicates between the first and second channels 274, 284 so that condensate collected in both of the channels 274, 284 can be directed through the bore 286 and out through the drain 276.

Still another construction of the coupling is illustrated in FIGS. 13-16. The coupling (indicated generally at 334) employs much of the same structure and has many of the same operational features as the couplings 134, 234 described above and illustrated in FIGS. 1-7 and 10A-10E and FIGS. 11-12. Accordingly, the following description of the coupling 334 focuses primarily upon those elements and features of the coupling 334 that are different from the constructions described above. Reference should be made to the above description for additional information regarding the elements, operation and possible alternatives to the elements and operation of the coupling 334 not discussed below. Elements and features of the coupling 334 corresponding to the earlier-described couplings 134, 234 are designated hereinafter in the 300 series of reference numbers.

Figure 13:
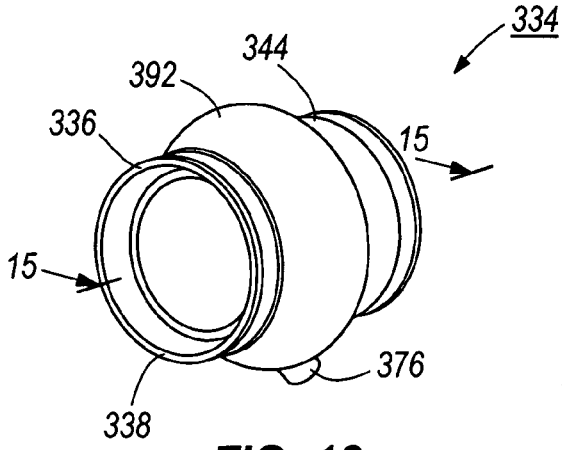
FIG. 13 is a perspective view of another alternate construction of a coupling.
Figure 14:
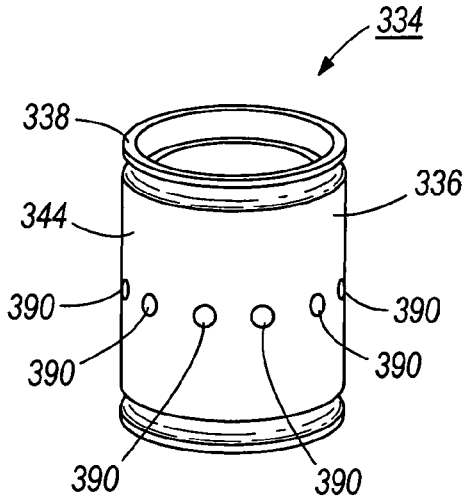
FIG. 14 is a side perspective view of a portion of the coupling shown in FIG. 13.
Figure 15:
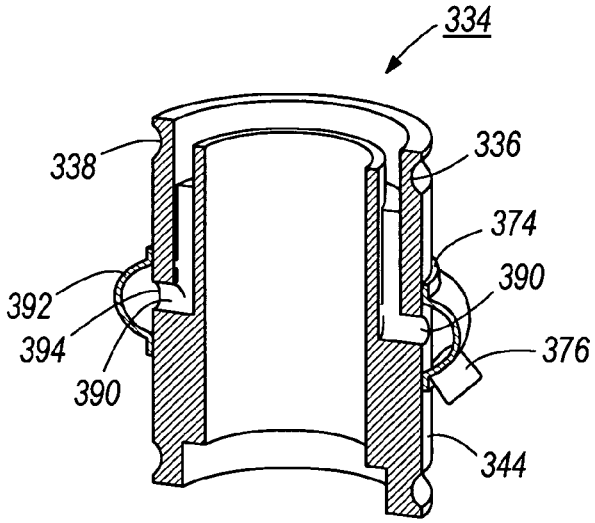
FIG. 15 is a cross-sectional view of the coupling taken along line 15-15' in FIG. 13.
Figure 16:
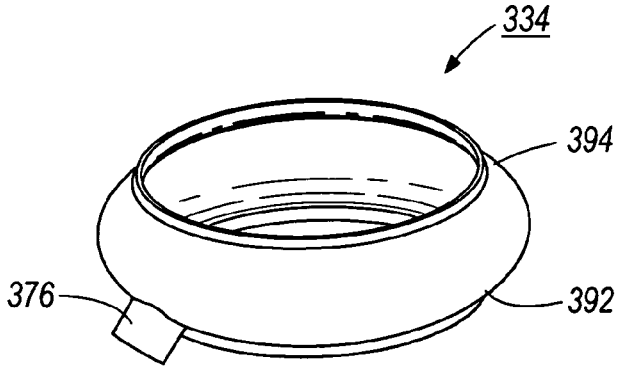
FIG. 16 is a perspective view of a portion of the coupling shown in FIG. 13.

In the illustrated construction of FIGS. 13-16 and in some aspects, a number of bores 390 extend through the outer wall 344 of the first tube 336 and communicate with the channel 374. A collar 392 is secured to the outer wall 344 of the first tube 336 and defines a channel 394, which extends circumferentially around the collar 392. As shown in FIGS. 13 and 15, when the collar 392 is secured to the first tube 336, the channel 374 is aligned with the bores 390. The collar 392 also includes a radially outwardly extending drain 376. In this manner, condensate collected in the channel 374 travels radially outwardly through the bores 390 and travels along the channel 394 toward the drain 376. The drain 376 then directs the condensate away from the collar 334.

To improve flow to the drain 376 and to improve flow out of the drain 376, the collar 392 can be pivoted relative to the first tube 336 so that the drain 376 opens downwardly toward the floor.

Figure 18:
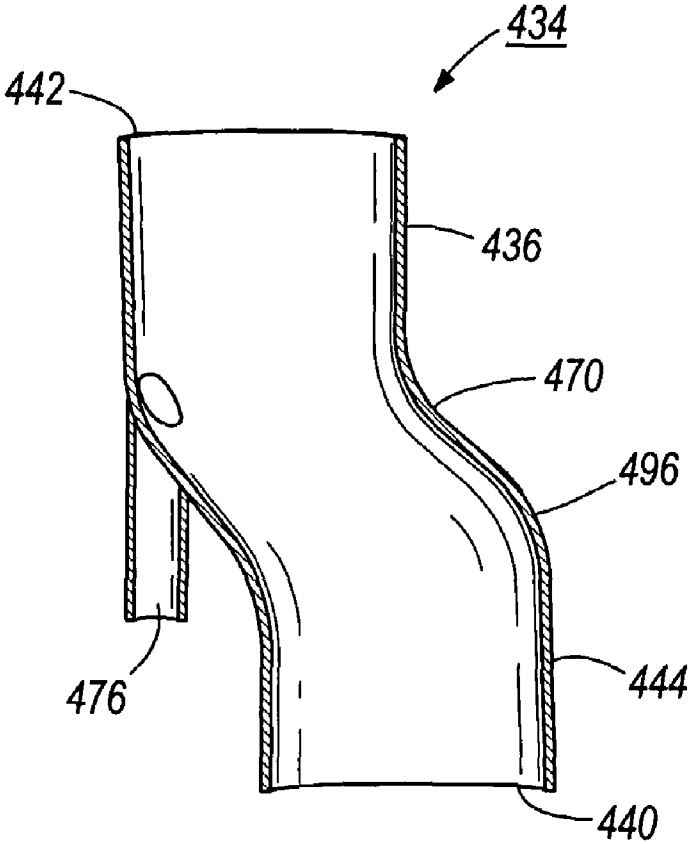
FIG. 18 is a partial cross-sectional view of the coupling shown in FIG. 17.
Figure 17:
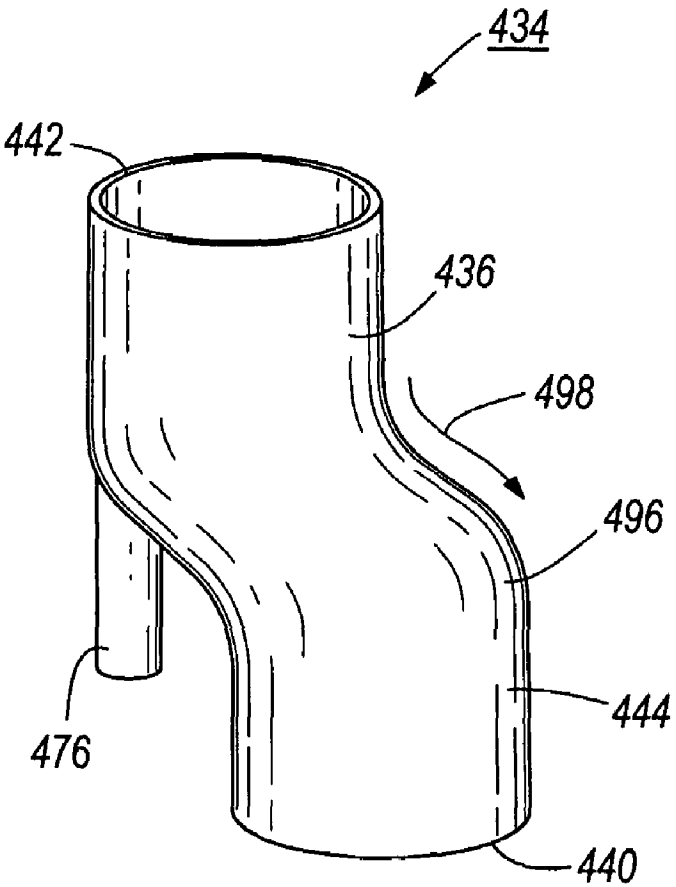
FIG. 17 is a perspective view of another alternate construction of a coupling.

Another construction of the coupling is illustrated in FIGS. 17-18. The coupling (indicated generally at 434) employs much of the same structure and has many of the same operational features as the couplings 134, 234, 334 described above and illustrated in FIGS. 1-7 and 10A-10E, FIGS. 11-12 and FIGS. 13-16. Accordingly, the following description of the coupling 434 focuses primarily upon those elements and features of the coupling 434 that are different from the constructions described above. Reference should be made to the above description for additional information regarding the elements, operation and possible alternatives to the elements and operation of the coupling 434 not discussed below. Elements and features of the coupling 434 corresponding to the earlier-described couplings 134, 234, 334 are designated hereinafter in the 400 series of reference numbers.

In some constructions and in some aspects, the coupling 434 is formed of a single integral tube 436 having an upstream end 440, a downstream end 442 and a wall 444 extending therebetween. As shown in FIGS. 17-18, the coupling 434 includes a bend 496 located between the upstream and downstream ends 440, 442 and defines an offset passageway (represented by arrow 498 in FIG. 18) between the upstream and downstream ends 440, 442. A drain 476 extends outwardly from the wall 444 and communicates between the interior of the coupling 434 and the atmosphere.

In the illustrated construction of FIGS. 17-18 and in some aspects, the coupling 434 also includes a rib 470 extending circumferentially around the inner side of the wall 444. At least a portion of the rib 470 is angled downwardly toward the drain 476 to direct condensate toward the drain 476.

In operation, the upstream end 440 of the coupling 434 is secured to the exhaust duct 84 and the downstream end 442 is secured to the venting system. Condensate formed along the walls of the venting system drains downwardly toward the blower 12 and enters the coupling 434. The condensate then travels downwardly along the wall 444 of the coupling 434 and is directed circumferentially along the rib 470 toward the drain 476. In the illustrated construction and in some aspects, condensate exits the drain 476 and is allowed to flow onto the floor or into a collection bucket arranged below the drain 476. In other constructions and in other aspects, the drain 476 can be provided with a hose to direct the condensate to a floor drain or another desired collection point.

Figure 19:
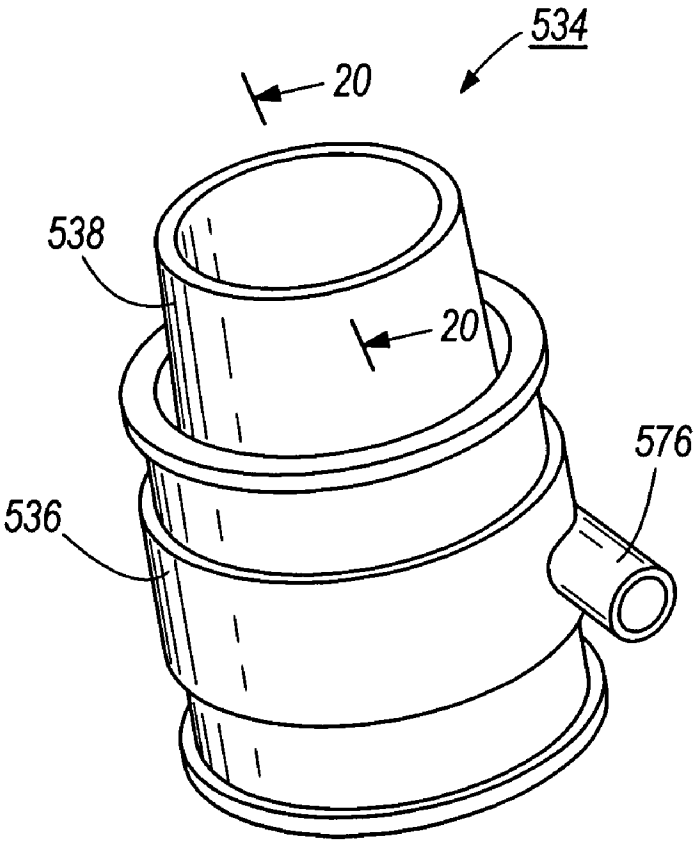
FIG. 19 is a perspective view of another alternative construction of a coupling.
Figure 20:
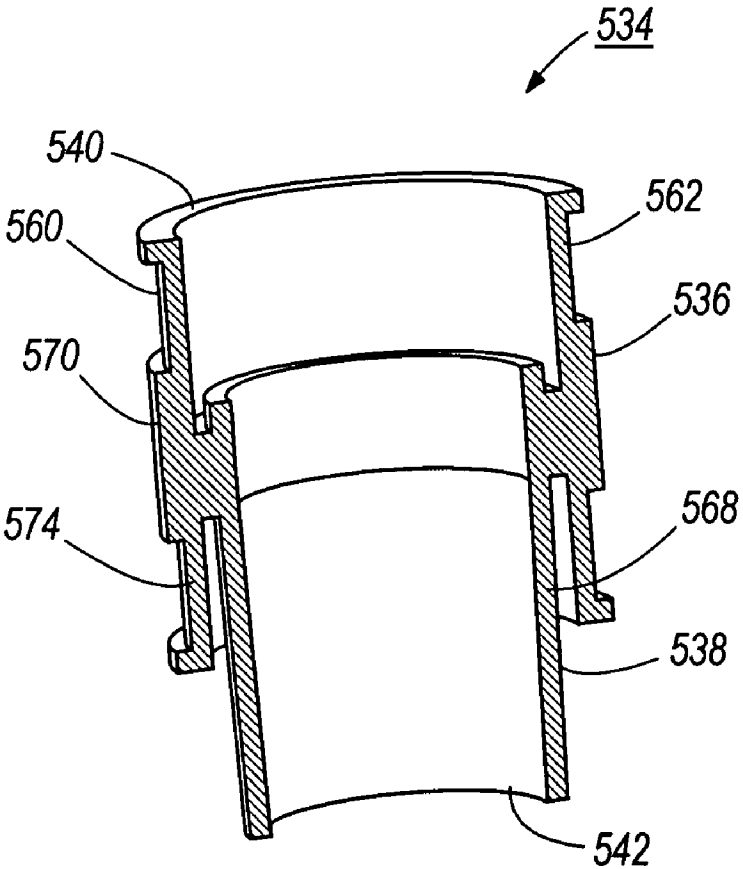
FIG. 20 is a cross-sectional view of the coupling taken along line 20-20' in FIG. 19.
Figure 21:
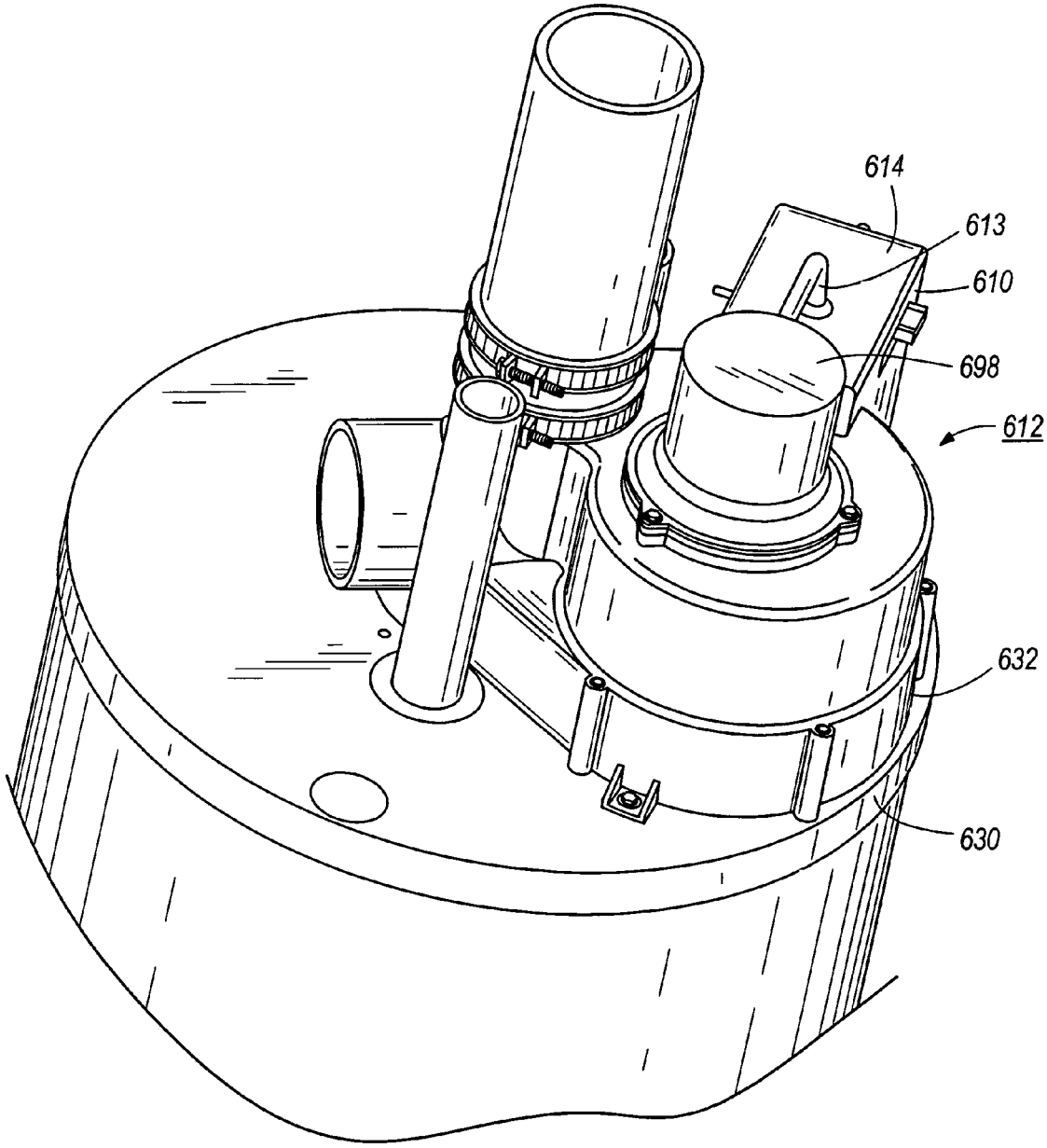
FIG. 21 is a top perspective view of an alternate construction of a water heater including a blower and a coupling.
Figure 22:
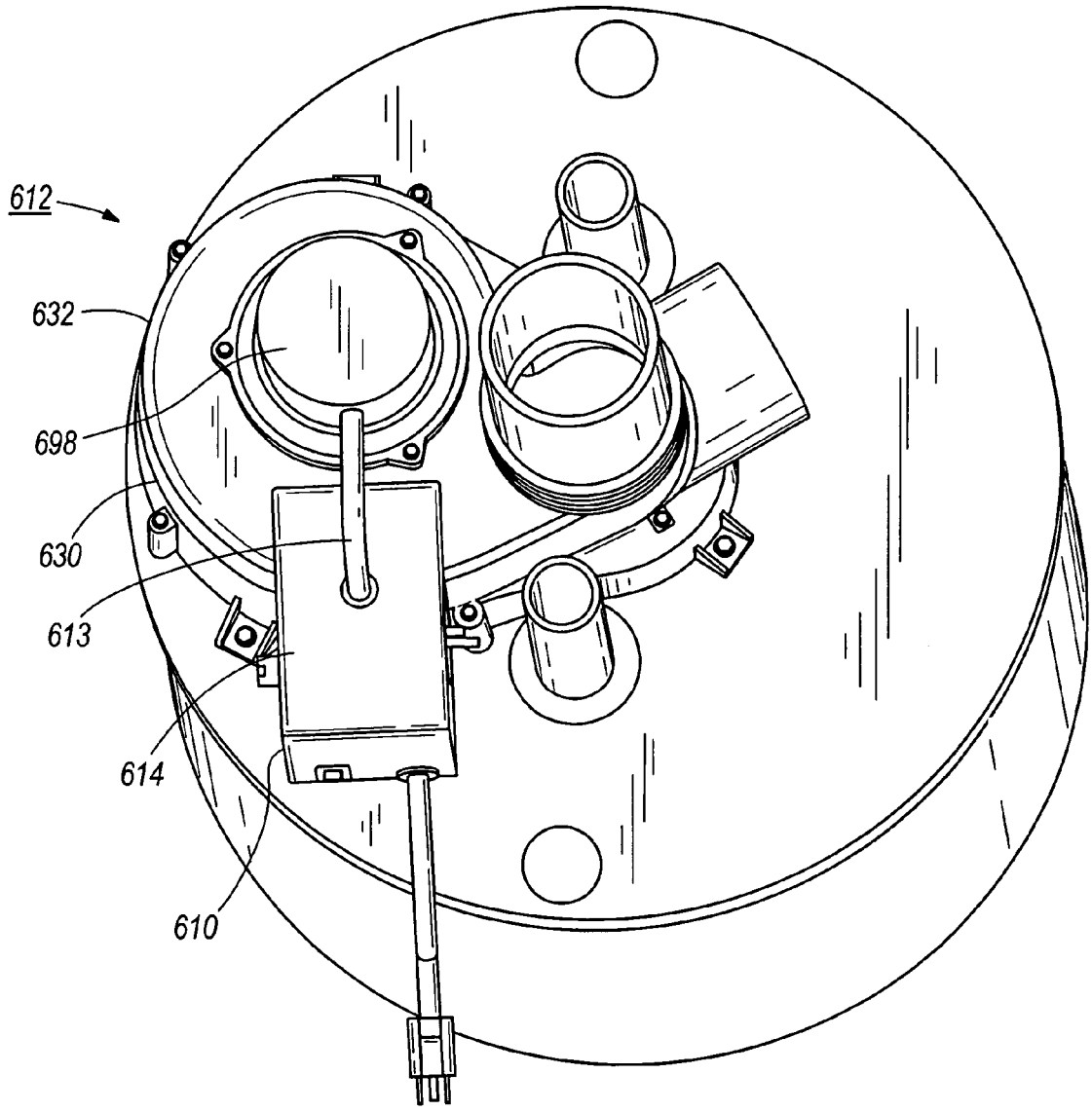
FIG. 22 is a top view of the water heater and the blower shown in FIG. 21.
Figure 23:
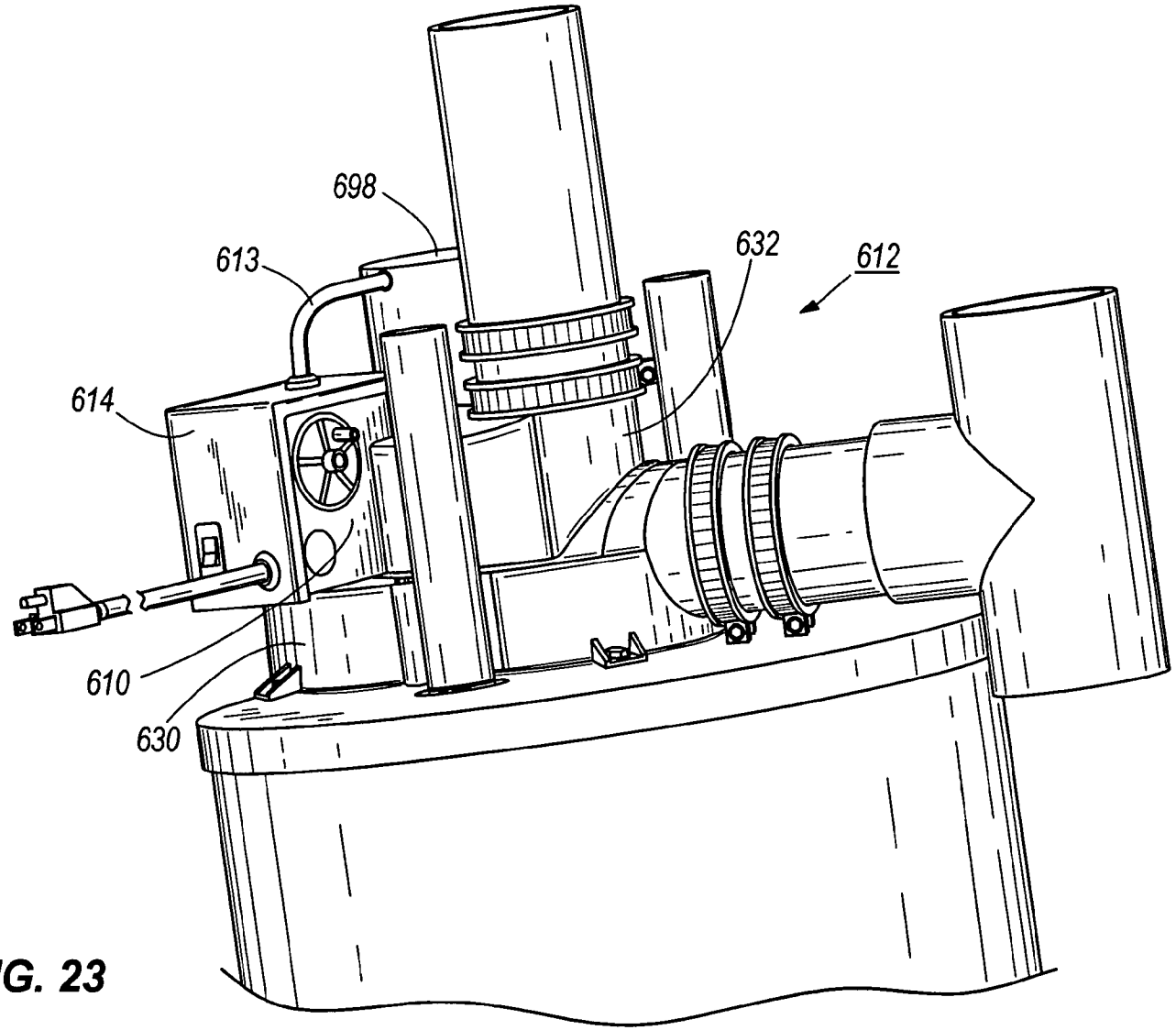
FIG. 23 is a perspective view of a first side of the water heater and the blower shown in FIG. 21.
Figure 24:
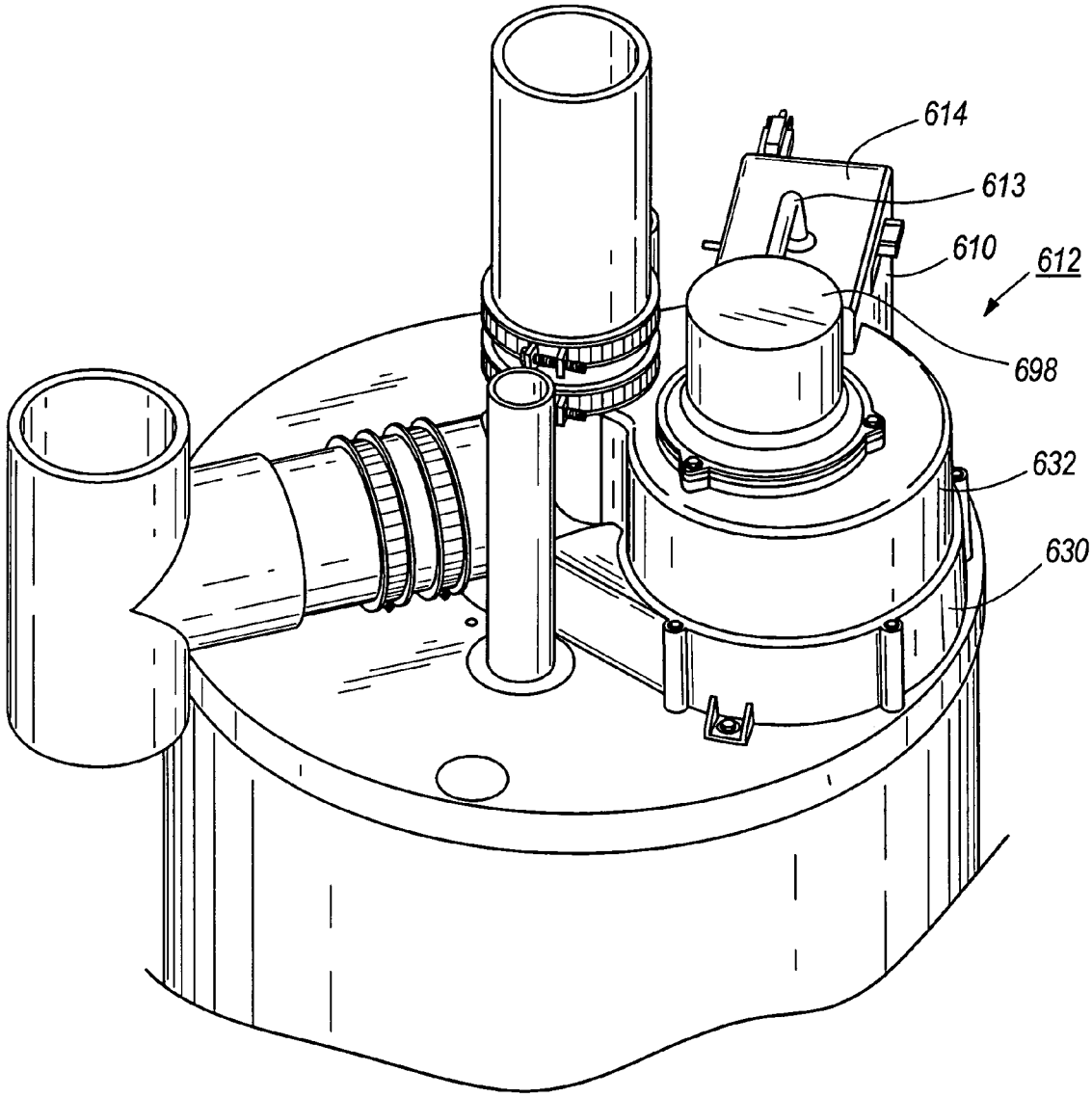
FIG. 24 is a perspective view of a second side the water heater and the blower shown in FIG. 21.
Figure 26:
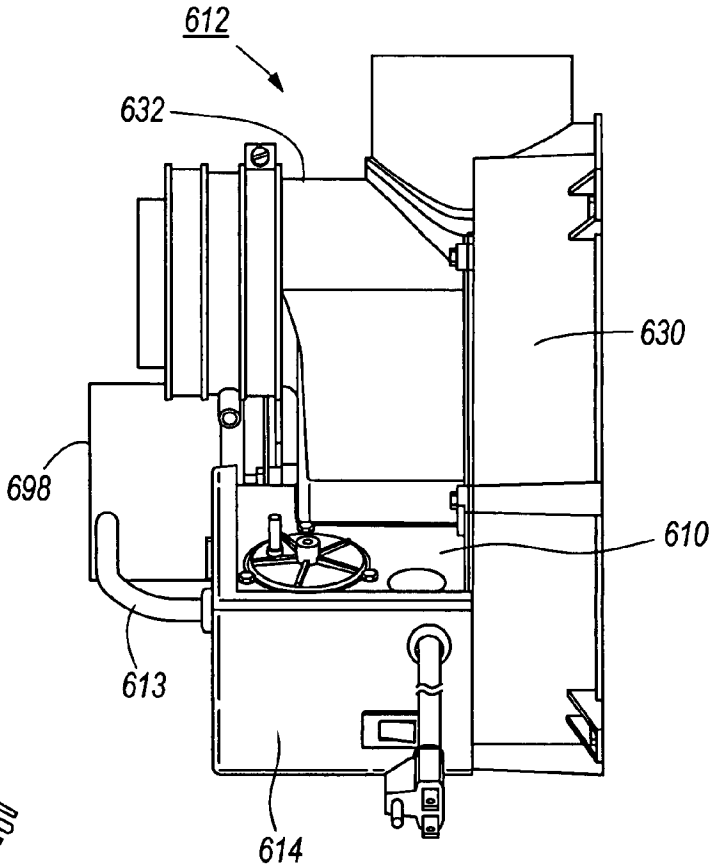
FIG. 26 is a side view of the blower shown in FIG. 21.
Figure 25:
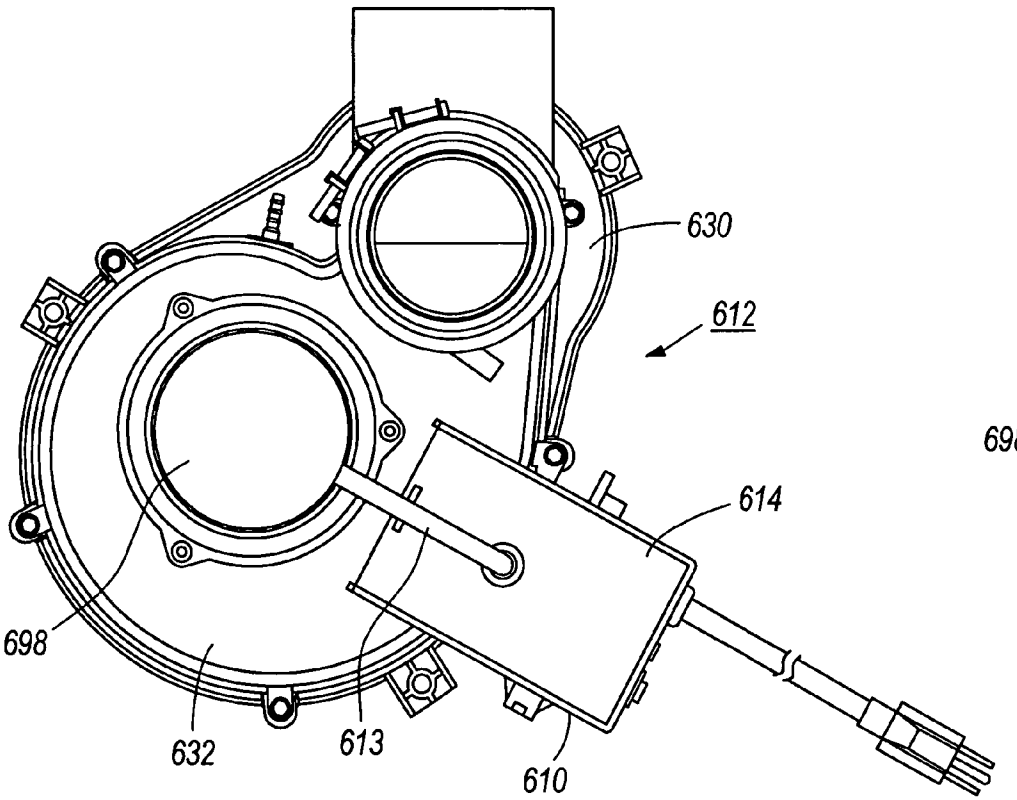
FIG. 25 is a top view of the blower shown in FIG. 21.
Figure 27:
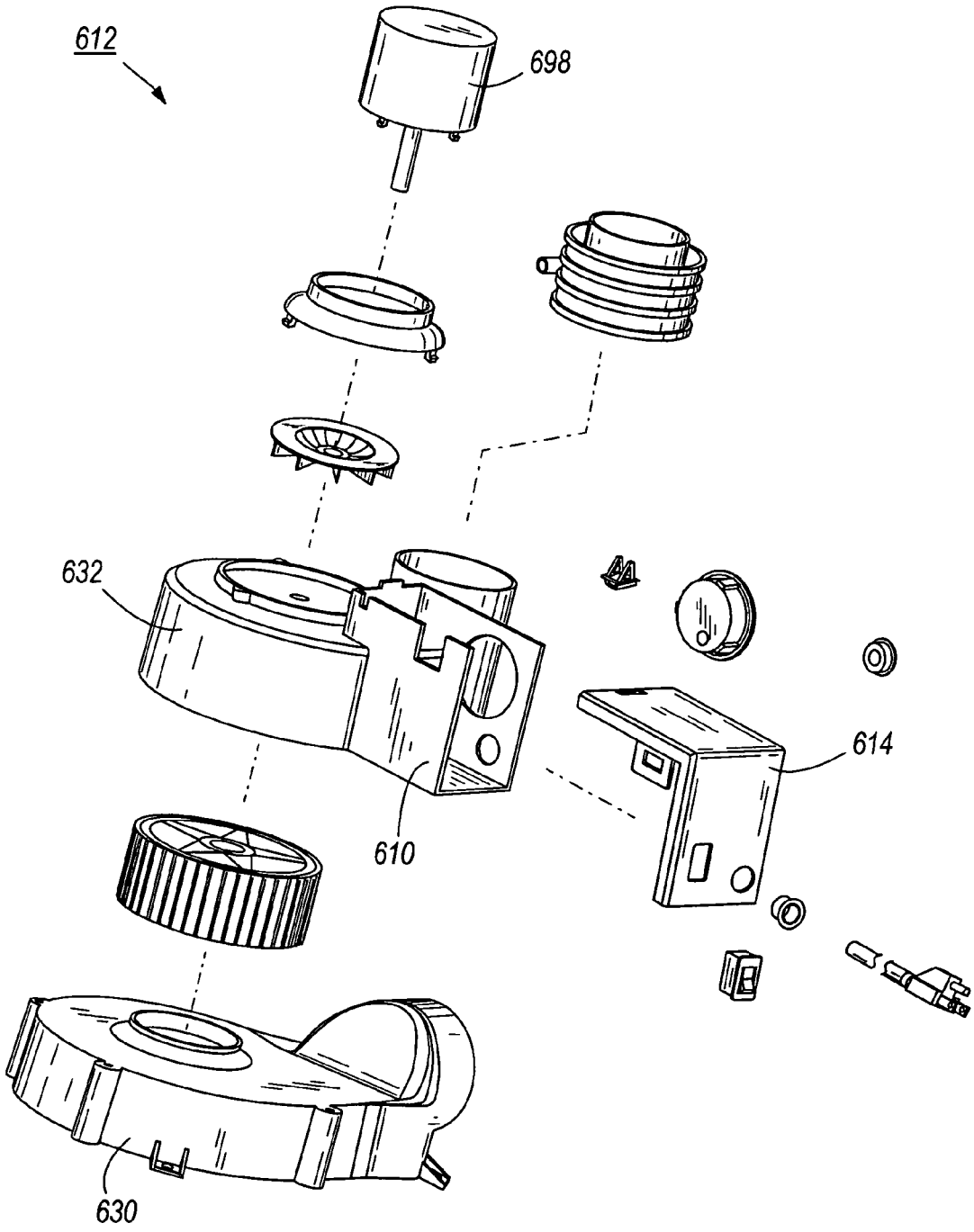
FIG. 27 is an exploded perspective view of the blower shown in FIG. 21.
Figure 28A:
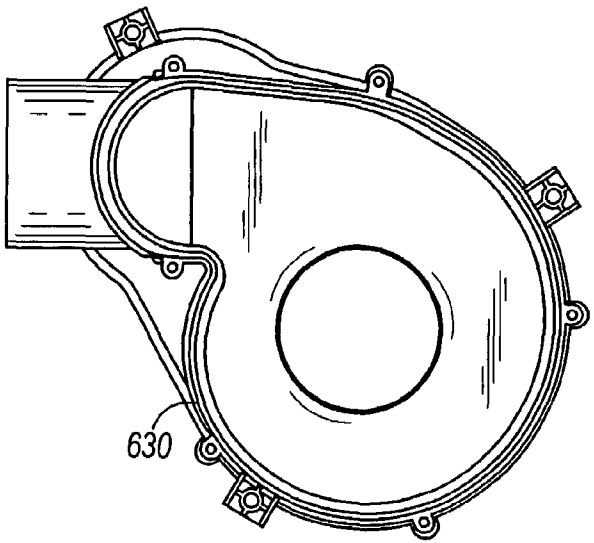
FIG. 28A is a top view of a lower housing of the blower shown in FIG. 21.
Figure 28C:
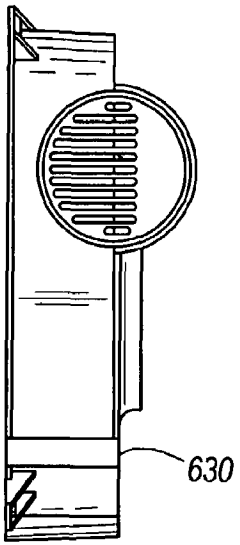
FIG. 28C is a front view of the lower housing shown in FIG. 28A.
Figure 28B:
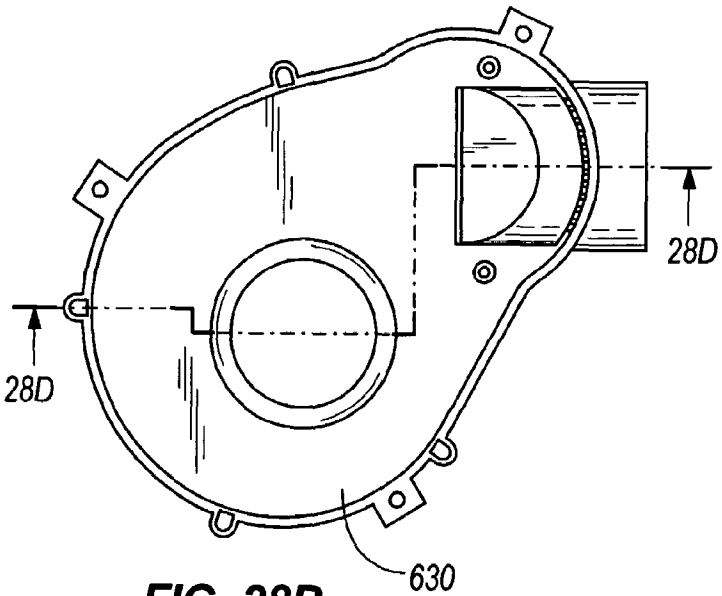
FIG. 28B is a bottom view of the lower housing shown in FIG. 28A.
Figure 28D:
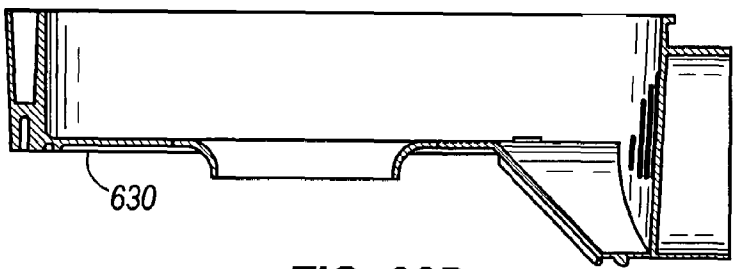
FIG. 28D is a side view of the lower housing shown in FIG. 28A.

Another construction of the coupling is illustrated in FIGS. 19-20. The coupling (indicated generally at 534) employs much of the same structure and has many of the same operational features as the couplings 134, 234, 334, 434 described above and illustrated in FIGS. 1-7 and 10A-10E, FIGS. 11-12, FIGS. 13-16 and FIGS. 17-18. Accordingly, the following description of the coupling 534 focuses primarily upon those elements and features of the coupling 534 that are different from the constructions described above. Reference should be made to the above description for additional information regarding the elements, operation and possible alternatives to the elements and operation of the coupling 534 not discussed below. Elements and features of the coupling 534 corresponding to the earlier-described couplings 134, 234, 334, 434 are designated hereinafter in the 500 series of reference numbers.

As shown in FIGS. 19 and 20, the coupling 534 includes first and second substantially concentric tubes 536, 538. The upstream end 540 of the first tube 536 can be secured to the exhaust duct 84 and the downstream end 542 of the first tube 536 can be secured to the venting system or, alternatively, the upstream end 540 of the first tube 536 can be secured to the venting system and the downstream end 542 of the first tube 536 can be secured to the exhaust duct 84.

A lip 560 extends radially inwardly from the interior of the first tube 536 and is secured to an upstream end 562 of the second tube 538. Together, a rib 570, a downstream side of the lip 560 and a wall 568 of the second tube 538 define a channel 574. A drain 576 extends radially outwardly through the first tube 536 and communicates between the channel 574 and the atmosphere.

In some constructions and in some aspects, the coupling 534 can be pivoted relative to the exhaust duct or, alternatively, relative to the venting system to orient the drain 576 for improved drainage. Specifically, the coupling 534 can be pivoted so that condensate collected in the coupling 534 flows toward the drain 576 and so that the condensate collected in the drain 576 flows out of the drain 576 and away from the water heater 10.

While reference is made herein to a blower 12, a water heater 10 and couplings 134, 234, 334, 434, 534 and to a method of mounting the blower 12 and the couplings 134, 234, 334, 434 on the water heater 10, it should be understood that the blower 12 and the coupling 134, 234, 334, 434, 534 of the present invention can also or alternately be used with other devices, such as, for example, furnaces, boilers, etc.

FIGS. 21-28A illustrate an alternate embodiment of a water heater including a blower according to the present invention. The blower in FIGS. 21-28A is similar in many ways to the illustrated constructions of FIGS. 1-20 described above. Accordingly, with the exception of mutually inconsistent features and elements between the constructions of FIGS. 21-28A and the constructions of FIGS. 1-20, reference is hereby made to the description above accompanying the constructions of FIGS. 1-20 for a more complete description of the features and elements (and the alternatives to the features and elements) of the construction of FIGS. 1-20. Features and elements in the construction of FIGS. 21-28A corresponding to features and elements in the constructions of FIGS. 1-20 are numbered in the 300 and 400 series.

Another construction of the blower is illustrated in FIGS. 21-28D. The blower (indicated generally at 612) employs much of the same structure and has many of the same operational features as the blower 12 described above and illustrated in FIGS. 1-9F. Accordingly, the following description of the blower 612 focuses primarily upon those elements and features of the blower 612 that are different from the constructions described above. Reference should be made to the above description for additional information regarding the elements, operation and possible alternatives to the elements and operation of the blower 612 not discussed below. Elements and features of the blower 612 corresponding to the earlier-described blower 12 are designated hereinafter in the 600 series of reference numbers.

In some constructions and in some aspects, the blower 612 includes a first or lower housing 630 and a second or upper housing 632 or housing portions. The blower 610 also includes an electrical component housing 610. An electrical conduit 613 extends outwardly through the two-sided cover 614 of the housing 610 toward the motor 698, electrically connecting the motor 698 to the controller, the electrical circuit, and/or the power source.

Although particular constructions of the present invention have been shown and described, other alternative constructions will be apparent to those skilled in the art and are within the intended scope of the present invention.

What is claimed is:

1. A blower for a water heater having a flue defining a flue axis, the blower comprising:

a housing at least partially defining a first chamber and a second chamber and having an inlet opening into the first chamber and an outlet communicating between the second chamber and atmosphere, the inlet being alignable with the flue;

a ramp extending through the second chamber and having a surface, the surface being oriented at an acute angle with respect to the flue axis; and an impeller positioned in the second chamber and being operable to draw exhaust from the flue into the first chamber through the inlet and being operable to direct the exhaust from the first chamber through the second chamber and across the surface of the ramp, the surface of the ramp directing the exhaust through the outlet in a direction substantially parallel to the flue axis.

2. The blower of claim 1, wherein the housing includes a second inlet opening into the first chamber for receiving ambient air.

3. The blower of claim 1, wherein the ramp includes a second surface opposite the first surface, the second surface being oriented at an obtuse angle with respect to the flue axis.

4. The blower of claim 3, wherein the housing defines a second inlet opening into the first chamber for receiving ambient air, and wherein the second surface is positioned adjacent to the second inlet for directing the ambient air toward the first inlet.

5. The blower of claim 1, wherein the housing defines a second inlet opening into the first chamber for receiving ambient air, and wherein the ambient air cools the exhaust before the exhaust enters the second chamber.

6. The blower of claim 1, wherein the housing defines a second inlet opening into the first chamber, and wherein the second inlet directs ambient air into the flue.

7. The blower of claim 1, wherein the impeller directs exhaust through the second chamber in a direction substantially normal to the flue axis.

8. A blower for a water heater having a flue defining a flue axis, the blower comprising:

a housing at least partially defining a first chamber and a second chamber and having a first inlet opening into the first chamber, a second inlet opening into the first chamber for receiving ambient air, and an outlet communicating between the second chamber and atmosphere, the first inlet being alignable with the flue;

an impeller positioned in the second chamber, the impeller being operable to draw exhaust from the flue into the first chamber through the first inlet and being operable to draw the exhaust into the second chamber before directing the exhaust through the outlet; and a ramp extending through the first chamber adjacent to the second inlet for directing ambient air from the second inlet toward the first inlet.

9. The blower of claim 8, wherein the impeller directs exhaust through the second chamber in a direction substantially normal to the flue axis.

10. The blower of claim 8, wherein the ramp includes a surface oriented at an obtuse angle with respect to the flue axis.

11. The blower of claim 8, wherein the ramp includes a surface oriented to direct the exhaust through the outlet in a direction substantially parallel to the flue axis.

12. The blower of claim 8, wherein the ramp includes a first surface oriented at an acute angle with respect to the flue axis and a second surface oriented at an obtuse angle with respect to the axis.

13. The blower of claim 8, wherein the ambient air cools the exhaust before the exhaust enters the second chamber.

14. A water heater comprising:

a flue defining a flue axis; and a blower including a housing at least partially defining a first chamber and a second chamber and having an inlet opening into the first chamber and an outlet communicating between the second chamber and atmosphere, the inlet being alignable with the flue;

a ramp having a first surface extending through the second chamber and being oriented at an acute angle with respect to the flue axis, and a second surface extending through the first chamber and positioned opposite the first ramp surface, the second surface being oriented at an obtuse angle with respect to the axis; and an impeller positioned in the second chamber and being operable to draw exhaust from the flue into the first chamber through the inlet and being operable to direct the exhaust through the second chamber and through the outlet.

15. The water heater of claim 14, wherein the first surface is positioned adjacent to the outlet to direct exhaust toward the outlet in a direction substantially parallel to the flue axis.

16. The water heater of claim 14, wherein the housing defines a second inlet opening into the first chamber for receiving ambient air, and wherein the second surface is positioned adjacent to the second inlet for directing the ambient air toward the first inlet.

17. The water heater of claim 14, wherein the impeller directs the exhaust through the second chamber in a direction substantially normal to the flue axis.

18. The water heater of claim 14, wherein ambient air cools the exhaust before the exhaust enters the second chamber.

19. The water heater of claim 14, wherein the impeller is operable to direct the exhaust through the second chamber and across the first surface, and wherein the first surface directs the exhaust through the outlet in a direction substantially parallel to the flue axis.

20. The water heater of claim 14, wherein the second surface directs ambient air into the flue.

21. A method of operating a blower for a water heater, the water heater including a flue defining a flue axis, the blower including a housing at least partially defining a first chamber and a second chamber and having an inlet opening into the first chamber and an outlet communicating between the second chamber and atmosphere, and an impeller positioned in the second chamber, the method comprising the acts of:

moving the impeller with respect to the housing to draw exhaust from the flue through the inlet into the first chamber and from the first chamber into the second chamber; and directing the exhaust through the outlet along a path substantially coaxial with the flue axis.

22. The method of claim 21, wherein the housing includes a second inlet opening into the first chamber, and further comprising the act of drawing ambient air into the first chamber through the second inlet.

* * * * *